United States Patent [19]

Rama Prasad

[11] Patent Number: 4,905,752

[45] Date of Patent: Mar. 6, 1990

[54] METHOD OF CASTING A METAL ARTICLE

[75] Inventor: T. V. Rama Prasad, Mentor, Ohio

[73] Assignee: PCC Airfoils, Inc., Cleveland, Ohio

[21] Appl. No.: 312,044

[22] Filed: Feb. 16, 1989

Related U.S. Application Data

[63] Continuation-in-part of Ser. No. 174,007, Mar. 28, 1988, Pat. No. 4,809,764.

[51] Int. Cl.[4] ..... B22D 27/04

[52] U.S. Cl. ..... 164/122.1; 164/125; 164/127

[58] Field of Search ..... 164/122, 122.1, 122.2, 164/125, 127, 338.1, 349, 350, 348, 352, 361, 359

[56] References Cited

U.S. PATENT DOCUMENTS

| | | | |
|---|---|---|---|
| 486,327 | 11/1892 | Cushing et al. | 164/355 |
| 3,598,167 | 8/1971 | Snyderman | 164/517 |
| 3,847,203 | 11/1974 | Northwood | 164/96 |
| 4,202,400 | 5/1980 | Gigliotti, Jr. et al. | 164/122.1 |
| 4,469,161 | 9/1984 | Higginbotham et al. | 164/122.1 |
| 4,714,101 | 12/1987 | Terkelsen | 164/122.1 |
| 4,724,891 | 2/1988 | Brookes | 164/122.1 |

*Primary Examiner*—Richard K. Seidel

*Attorney, Agent, or Firm*—Tarolli, Sundheim & Covell

[57] ABSTRACT

A long thin article having an enlarged end portion, such as a vane having a long thin airfoil and a shroud at the end of the airfoil, is cast by using a chill at the enlarged end portion of an article mold cavity. The chill is engaged by molten metal at the enlarged end portion of the article mold cavity. The molten metal quickly solidifies adjacent to the chill to eliminate the formation of defects. The chill is advantageously located in a pocket disposed at one end of the article mold cavity. The chills are placed in the pockets with the molds in an up-side-down orientation. The mold is then turned right-side-up and placed on a chill plate. The chills project from the mold and support the mold above the chill plate. During casting of an article, heat is transmitted from the enlarged end portion of the article through chill to the chill plate.

41 Claims, 7 Drawing Sheets

METHOD OF CASTING A METAL ARTICLE

BACKGROUND OF THE INVENTION

This application is a continuation-in-part of U.S. patent application Ser. No. 174,007, filed Mar. 28, 1988, now U.S. Pat. No. 4,809,764. The benefit of the earlier filed application Ser. No. 174,007 has been and hereby is claimed for any common subject matter.

The present invention relates to a method of casting a metal article and more specifically to a casting method in which a chill member is provided at one end of an article mold cavity. The method is advantageously used in conjunction with the casting of long thin metal articles.

When a long thin metal article with an equiaxed grain structure is to be cast, it is a common practice to provide gating at various locations along the length of the mold cavity. This gating conducts feed metal which compensates for shrinkage of the metal during solidification. The number of gates depends upon the relationship between the length of the article being cast and the thickness of the article. It has been a common practice to provide gates which are spaced apart along the length of an article mold by a distance of between 3 to 12 times the thickness of the article being cast.

The use of gates promotes the formation of defects in castings. Thus, hot tears and/or distortion tends to occur in the article where a gate is connected with the article. In addition, a stub usually remains at a location where the gate is cut off. This stub must be ground away. Grinding away of the stub is relatively difficult when the surface of the article has a curved configuration. Another disadvantage associated with the use of gates is that an area of distinctly larger grain size is formed in the area where the gate was connected with the article.

Long thin articles have previously been cast with a directionally solidified or columnar grained crystalographic structure. When this is done, the mold is preheated to a relatively high temperature which is substantially above the liquidus temperature of the metal of which the cast article is to be formed. Super heated molten metal is then poured into the preheated mold. Heat is supplied to the mold during pouring so that the metal remains molten during and immediately after pouring.

After the mold has been filled with molten metal, the molten metal is solidified upwardly in the article mold cavity along a horizontal front. Thus, the molten metal is solidified from the bottom of the mold upwardly to an upper end of the mold along a generally horizontal interface or front to prevent the formation of shrinkage voids. The solidification of the molten metal in this manner with a columnar grained crystalographic structure is promoted by withdrawing the mold downwardly from a furnace.

The casting of thin articles is described is U.S. patent application Ser. No. 813,247 filed Dec. 24, 1985 by Ronald R. Brookes and entitled Thin Wall Casting, now U.S. Pat. No. 4,724,891. A general method of directionally solidifying a casting is described in U.S. Pat. No. 4,609,029.

When long thin cast articles have substantial bodies of metal at enlarged ends of the articles, defects may tend to occur at locations adjacent to the interconnection between the long thin articles and the enlarged ends of the articles. These defects are caused, in part at least, by thermal gradients which result from the presence of the bodies of metal at the ends of the long thin articles. For example, when the article to be cast is a turbine engine component having a long thin airfoil portion and a shroud with a platform and one or more relatively substantial rails or projections, defects tend to occur at or adjacent to the junction between the shroud and airfoil.

SUMMARY OF THE INVENTION

The present invention relates to a new and improved method of casting a metal article by using a chill. The metal article may be long and thin and have an equiaxed grain structure. The article is cast in a mold cavity having a configuration corresponding to the configuration of the article. If the article to be cast is long and thin, the article mold cavity is free of gating and risers between opposite ends of a long thin portion of the mold cavity. Thus, there are no gates or risers along the length of a long thin portion of the mold cavity.

When a long thin article is to be cast, the mold is preheated so that a lower half of the portion of the article mold in which the long thin portion of the article is cast is at a temperature which is close to but less than the solidus temperature of the metal of the article. The upper half of the portion of the article mold in which the long thin portion of the article is cast may be heated to a temperature which is either somewhat above or below the solidus temperature of the metal of the article to be cast. Molten metal is conducted into the article mold cavity through an inlet from a gate or runner at the upper end of the article mold cavity. If desired, a second gate or a riser could be connected with the lower end of the article mold cavity.

During and immediately after pouring, the molten metal may be simultaneously solidified along at least fifty percent of the surface area of the lower half of the portion of the article mold cavity in which the long thin portion of the article is cast and along at least fifty percent of the surface area of the upper half of the portion of the article mold cavity in which the long thin portion of the article is cast. The molten metal in the lower half of the portion of the article mold cavity in which the long thin portion of the article is cast is completely solidified before the molten metal in the upper half of this portion of article mold cavity is completely solidified. During solidification of the molten metal with an equiaxed grain structure, shrinkage is compensated for by feeding metal to the long thin portion of the article mold cavity through the inlet at which molten metal was originally conducted to the long thin portion of the article mold cavity.

When the article to be cast is a turbine engine component having a long thin airfoil portion and a shroud portion, a chill member may be provided in association with the shroud portion of the turbine engine component. The chill member effects the temperature gradients which are set up during casting to prevent the formation of defects in the casting at a location adjacent to the shroud. In one embodiment of the invention, the chill member is engaged by molten metal in a shroud rail forming portion of a mold. In this embodiment of the invention, the chill member is spaced from a platform portion of the mold.

Regardless of whether or not the articles being cast have long thin portions, the chill members may advantageously be located in pockets disposed at lower end portions of article mold cavities. The chill receiving pockets may have openings in a bottom surface of a base of the mold. To provide access to the pockets when the openings are in the bottom surface of the mold, the mold is turned up-side-down and the chill members are inserted into the pockets. The mold is then turned right-side-up and used to cast the articles.

Although the chill members can be located relative to article molds in other ways, the chill members may be advantageously used to support the mold structure above a chill plate. Thus, the chill members support the weight of the mold structure with the mold structure spaced from the chill plate. Heat is transmitted from molten metal in the article molds, through the chill members, to the chill plate.

It should be understood that the foregoing features of the present invention may be utilized either together or separately. Although certain features make it possible to cast long thin articles having relatively heavy end portions without any gating along the length of the articles, these features may be used in conjunction with the casting of other types of articles.

Accordingly, it is an object of this invention to provide a new and improved method of casting a metal article having a long thin airfoil portion and a shroud portion with equiaxed grain structure and without providing gates at locations along the length of an airfoil forming portion of an article mold by positioning a chill adjacent to a shroud rail forming portion of the article mold and with the chill spaced from a shroud platform forming portion of the mold.

Another object of this invention is to provide a new and improved method of casting a plurality of metal articles by inserting chills into pockets in a base of a mold with the mold in an up-side-down orientation and subsequently using the mold in a right-side-up orientation to cast the articles.

Another object of this invention is to provide a new and improved method of casting a plurality of metal articles by supporting the weight of a mold structure on a plurality of chill members which are disposed on a chill plate with the mold structure spaced from the chill plate.

Another object of this invention is to provide a new and improved method as set forth in any of the preceeding objects and wherein an article having a long thin portion is cast without providing gates at locations along the length of the long thin portion of an article mold cavity.

BRIEF DESCRIPTION OF THE DRAWINGS

The foregoing and other objects and features of the present invention will become more apparent upon a consideration of the following description taken in combination with the accompanying drawings wherein.

DESCRIPTION OF SPECIFIC PREFERRED EMBODIMENTS OF THE INVENTION

Metal Article

Figure 1:
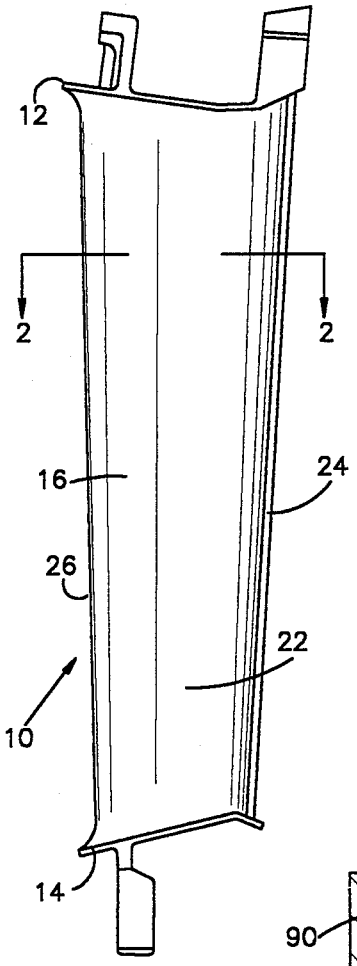
FIG. 1 is an elevational view of a metal article having a long thin portion.

A metal article 10 having a long thin portion is illustrated in FIG. 1. Although the present invention could be utilized to cast many different articles, the article 10 is a vane for use in a jet engine. Due to the relatively severe operating conditions to which the vane 10 is exposed, it is formed of a nickel chrome superalloy. The vane 10 has an equiaxed grain structure.

The vane or metal article 10 has an upper shroud portion 12 and a lower shroud portion 14. A long thin airfoil portion 16 extends between and is cast as one piece with the upper and lower shroud portions. The vane 10 has a length of approximately 8.25 inches. The airfoil portion 16 of the vane 10 has a length of approximately seven inches.

The airfoil portion 16 of the vane 10 has a width of approximately 2.5 inches. Thus, the distance between the leading edge portion 24 (FIG. 2) of the vane 10 and a trailing edge portion 26 of the vane, as measured along a central axis 28, is approximately 2.5 inches. Since the airfoil portion 16 of the vane 10 has a slight longitudinal taper, the distance between the leading and trailing edge portions 24 and 26 varies along the length of the vane 10. The airfoil portion 16 of the vane 10 has a maximum thickness of approximately 0.080 inches. The airfoil portion 16 of the vane 10 gets thinner toward the leading and trailing edge portions 24 and 26.

The generally rectangular shroud sections 12 and 14 of the one piece vane 10 are substantially thicker than the airfoil portion 16. Thus, the shroud sections 12 and 14 have a width of approximately an inch and a half and a height of approximately five-eighths of an inch. It should be understood that the vane 10 could have a configuration other than the specific configuration illustrated in FIGS. 1 and 2. For example, one or both shroud sections 12 and 14 could be omitted if desired. Although the vane 10 is formed of a nickel chrome superalloy, it is contemplated that blades, vanes or other articles cast in accordance with the method of the present invention may be formed of different metals. For example, articles which are long and thin or have portions which are long and thin may be cast of cobalt based alloys or iron based alloys. However, it is believed that the present invention will be particularly advantageous in the casting of nickel chrome superalloy blades and vanes.

The airfoil portion 16 of the vane 10 is a long thin article. Thus, the airfoil portion 16 of the vane 10 has a length (FIG. 1) of more than four inches. The length of the airfoil portion 16 of the vane 10 is also at least twenty times the thickness of the airfoil portion. Therefore, the airfoil portion 16 of the vane 10 meets the requirements for what is referred to herein as a long thin article. The specific vane 10 illustrated in FIGS. 1 and 2 has an airfoil portion 16 with a length which is approximately eighty-seven times the thickness of the airfoil portion.

Figure 3:
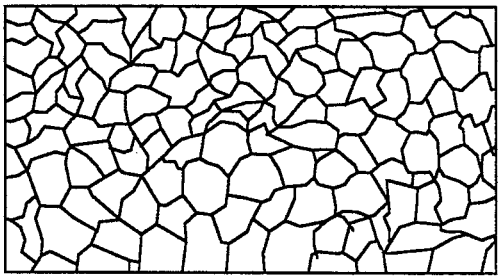
FIG. 3 is a greatly enlarged view illustrating equiaxed grains of the cast article of FIGS. 1 and 2.

The vane 10 has an equiaxed grain structure which is illustrated in FIG. 3. Thus, the vane 10 has numerous randomly orientated grains which are the result of random nucleation and grain growth during solidification of the molten metal forming the vane 10. The surface grains have a maximum dimension of one half of an inch or less. Although long thin blades and/or vanes have been formed with columnar grain structure or as a single crystal, conditions at certain locations in a jet engine are such as to make the use of an equiaxed grain structure the most economical.

Casting the Article

When casting an equiaxed metal article which is relatively long and thin or which has a portion which is long and thin, that is an article or a portion of an article having a length which is more than four inches and which is at least twenty times its thickness, it is customary to provide gates or passages at a plurality of locations along the length of the article. The customary gates or passages conduct molten metal to the long thin portion of the mold cavity during filling of the mold cavity with molten metal. The gates or passages also conduct molten metal to the long thin portion of the mold cavity to compensate for shrinkage of the metal as it solidifies.

Figure 2:
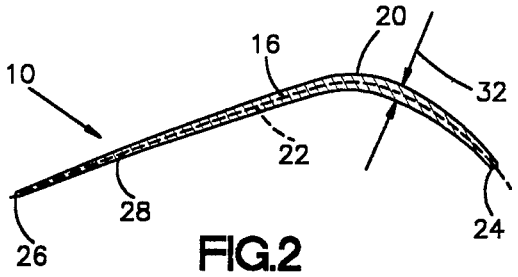
FIG. 2 is a sectional view, taken generally along the line 2—2 of FIG. 1, further illustrating the configuration of the long thin portion of the metal article.

When conventional casting practices were used in an attempt to cast a vane similar to the vane 10 of FIGS. 1 and 2, four gates were used. The gates were spaced apart along the convex side of the long thin portion of the mold cavity in which the airfoil portion 16 was to be cast. This particular vane had a long thin airfoil portion with a length of 11 inches and a maximum thickness of 0.120 inches. Of course, the number of gates which conventional practice indicates should be used will vary depending upon the type of mold, the metal being cast, and many other factors.

The use of a relatively large number of gates during the casting of a long thin article of equiaxed metal, such as the vane 10, substantially increases the cost of producing the article. The metal which solidifies in the gates is scrap which, in the case of expensive alloys, can contribute significantly to the cost of the article. In addition, the gates frequently result in casting defects, such as excessively large grains, hot tears and/or distortion.

When gates are connected with a curved surface in a mold, a stub end portion of the gate must be carefully ground away. The grinding must be carefully performed in order to provide the cast article with a continuous surface having the desired curvature. Thus, the grinding away of gate stubs from major side surfaces 20 and 22 of the airfoil 10 would be a laborious and time consuming process.

Figure 4:
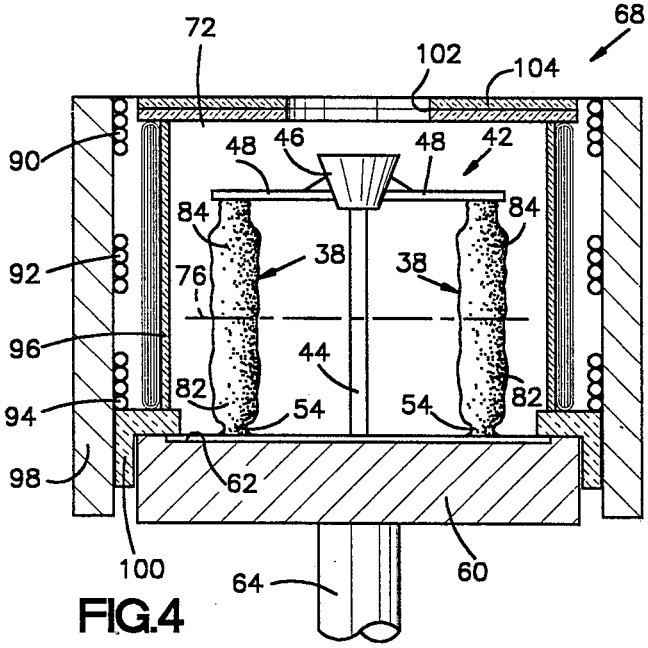
FIG. 4 is a schematic illustration of one way in which a mold structure for casting a plurality of the articles of FIGS. 1 and 2 may be supported on a chill plate in a furnace during preheating and pouring of molten metal into the mold structure.

In accordance with one of the features of the present invention, no gates were used along the length of the long thin portion of the mold cavity in which the vane 10 of FIGS. 1 and 2 was cast with an equiaxed grain structure. Thus, an article mold 38 (FIG. 4) having only a single inlet at its upper end was used to cast the vane 10. There are no gates along the sides of the article mold 38. However, it is contemplated that a blind riser or a gate could be provided at the lower end of the article mold if desired. The casting process was conducted in such a manner as to result in the vane 10 having a fine equiaxed grain structure, similar to the grain structure shown in FIG. 3. The vane 10 was free of shrinkage defects, hot tears and distortion.

For reasons of economy, it is preferred to cast a plurality of the vanes at a time. Therefore, a one piece mold structure 42 is used to cast a plurality of the vanes at a time. The mold structure 42 includes a circular array of twelve article molds 38. It should be understood that although only two article molds 38 have been shown in FIG. 4, the mold structure 42 may have eight, twelve, sixteen, or more article molds 38 disposed in an annular array or cluster about a solid support post 44.

A pour cup 46 is supported on an upper end of the support post 44. A plurality of gates or runners 48 extend outwardly from the pour cup 46 with one runner going to each article mold 38. The article molds 38 are supported on a circular base plate 52 by ceramic spacer blocks 54 having a height of three-eights to one and one-half inches. The spacer blocks 54 support the closed lower end portions of the article molds 38. The spacer blocks could be eliminated or could have different dimensions if desired.

When the mold structure 42 is to be made, a wax pattern is assembled. The wax pattern includes a plurality of article patterns having the same configuration as the configuration of the article to be cast, that is the same configuration as the vane 10. The article patterns did not have any gate patterns disposed along the length of the article patterns.

The wax patterns of the articles, that is, the vanes 10, are connected with wax patterns having a configuration corresponding to passages in the gates or runners 48. There is only one gate or runner passage pattern connected to the upper end of each vane pattern. The runner passage patterns are in turn connected with a pattern corresponding to the shape of the inside of the hollow pour cup 46. A ceramic spacer block 54 is connected with a lower end of each vane pattern. A ceramic support post extends between the pour cup pattern and a wax pattern of the base plate 52.

The entire pattern assembly is repetitively dipped in a slurry of ceramic mold material and stuccoed to build up a layer of mold material over the pattern assembly. Once a layer of desired thickness has been built up over the pattern assembly, the layer is dried. The wax pattern material is then melted and removed from the ceramic layer by the use of heat and/or chemical solutions. The ceramic mold material is then fired to give it the requisite strength and complete the process of forming the mold structure 42.

The process of making a mold structure similar to the mold structure 42 by the foregoing process is well known. However, it should be noted that the wax pattern and the resulting mold structure does not have any provision for gating passages to side portions of the article molds 38. The only passages for conducting molten metal to the article molds 38 from the pour cup 46 are in the runners 48.

When vanes or articles 10 are to be cast, the mold structure 42 is placed on a circular water cooled copper chill plate 60. Although the closed lower ends of the article molds are close to the chill plate 60, they are separated from the chill plate by three eights to one and one-half inches of ceramic material. The longitudinal central axes of article mold cavities in the article molds 38 are perpendicular to a horizontal upper side surface 62 of the chill plate 60.

A motor (not shown) then moves a cylindrical support post 64 for the chill plate 60 vertically upwardly. As the chill plate 60 moves upwardly, the mold structure 42 enters a chamber or housing (not shown) which encloses a furnace 68. Continued upward movement of the chill plate 60 moves the mold structure 42 into a cylindrical furnace chamber 72. The housing enclosing the furnace 68 is then evacuated and the mold structure 42 preheated.

The furnace preheats the mold structure 42 in a non-uniform manner. Thus, there is a temperature gradient which increases from a low temperature at the lower end of the article molds 38 to a higher temperature at the upper ends of the molds. An imaginary horizontal plane 76 extends through the centers of the long thin portions of the article molds 38 and divides the long thin portions of the article molds into a lower half 82 and an upper half 84.

The lower half 82 of the long thin portions of each of the article molds 38 is heated into a first temperature range. The highest temperature in this first temperature range is close to but is less than the solidus temperature of the metal of the vane 10. The upper half of the long thin portions of each of the article molds 38 is heated into a second temperature range. The second temperature range contains temperatures which are higher than the temperatures in the first temperature range. Since the upper and lower halves 82 and 84 of the long thin portions of the article molds 38 are separated by only an imaginary plane 76, the lowest temperature in the second temperature range into which the upper half 84 is heated is the same as the highest temperature of the temperature range into which the lower half 82 is heated.

The highest temperature of the second temperature range into which the upper half 84 of a long thin portion of an article mold 38 is heated is close to the solidus temperature of the molten metal of the vane 10. The highest temperature to which the upper half 84 of a long thin portion of an article mold 38 is heated may be somewhat greater than the solidus temperature of the metal of the vane 10 or somewhat less than the solidus temperature of the metal of the vane 10. Due to many different factors, the vertical temperature gradient along the mold 38 will probably not increase in exactly a uniform manner from the lower end of an article mold 38 to the upper end of the article mold. However, the temperature gradient will probably be similar to a uniform temperature gradient. It should be understood that the lower end of the article mold 38 is preheated to the lowest temperature and the upper end of the article mold is preheated to the highest temperature.

Preheating the lower half 82 to a temperature which is less than the temperature of upper half 84 is facilitated by having the mold structure 42 supported by the chill plate 60. In addition, helical coils 90, 92 and 94 are energized to different extents to further promote the desired temperature gradient. Thus, the amount of electrical energy which is conducted to the coil 90 is greater than the amount of electrical energy conducted to the coil 92. The amount of electrical energy conducted to the coil 92 is greater than the amount of electrical energy conducted to the coil 94. The differential energization of the coils 90–94 results in a differential in the heat energy transmitted through a graphite susceptor 96 to the article molds 38.

Although it is preferred to establish the temperature gradient between the upper and lower ends of the article molds 38 by the combined effect of the chill plate 60 and differential energization of the induction coils 90–94, the temperature gradient could be established by the use of baffles. Thus, a cylindrical baffle could be provided around the lower portion of the circular array of article molds 38. In addition, one or more annular baffles could extend radially inwardly from the cylindrical susceptor 96 to promote the establishment of a temperature gradient. Other baffle arrangements could be used if desired.

The coils 90, 92 and 94 are surrounded by a cylindrical furnace wall 98. An annular ceramic ring 100 is disposed adjacent to the lower end of the furnace wall 98. The susceptor 96 is seated on and supported by the ceramic ring 100. Of course, the furnace 68 could have a construction which is different than the specific construction shown in FIG. 4.

Regardless of how the temperature gradient is established, the upper end of a preheated article mold 38 is hotter than the lower end of the article mold. The temperature of the upper end of the long thin portion of a preheated article mold 38 is close to but may be either above or below the solidus temperature of the metal of the vane 10. The lower end of the long thin portion of the preheated article mold 38 is at a temperature which is approximately 50 to 500 degrees Fahrenheit less than the temperature of the upper end of the long thin portion of the article mold.

Once the article molds 38 have been preheated in the foregoing manner, molten metal is poured through an opening 102 in a circular upper end wall 104 of the furnace 68 into the pour cup 46. At the time of pouring, the molten metal is superheated by 50 to 400 degrees Fahrenheit. The pouring of the molten metal occurs in the vacuum chamber or housing which surrounds the furnace 68. Although it is preferred to fill the article mold cavity from only a single runner or gate 48 connected in fluid communication with the upper end of the article mold cavity, a second runner or gate could be connected with the lower end of the article mold cavity if desired.

Since seventy to one hundred percent of the length of each of the long thin portions of the article molds 38 is below the solidus temperature of the molten metal, random nucleation occurs over almost the entire surface of each article mold cavity when the molten metal is poured into the article molds. Although the exact extent of nucleation on the surfaces of the article mold cavities is not known, it is believed that nucleation and, therefore, initiation of solidification of the molten metal, occurs at locations which are disposed along at least the lower eighty to ninety percent of the long thin portion of each article mold cavity. This nucleation may be promoted by the presence of an inoculant in the molten metal.

As soon as the article molds 38 are filled with molten metal, withdrawal of the mold structure 42 from the furnace 68 begins. The rate of withdrawal of the mold structure 42 from the furnace 68 into the vacuum chamber surrounding the furnace is relatively high, that is 60 to 120 inches per hour. However, slower mold withdrawal speeds have also been used. Withdrawal of the mold assembly 42 from the furnace 68 is accomplished by lowering the chill plate 60 and its support post 64 at a constant speed. However, the speed of withdrawal of the mold structure 42 could be varied as the mold is withdrawn from the furnace.

Figure 5:
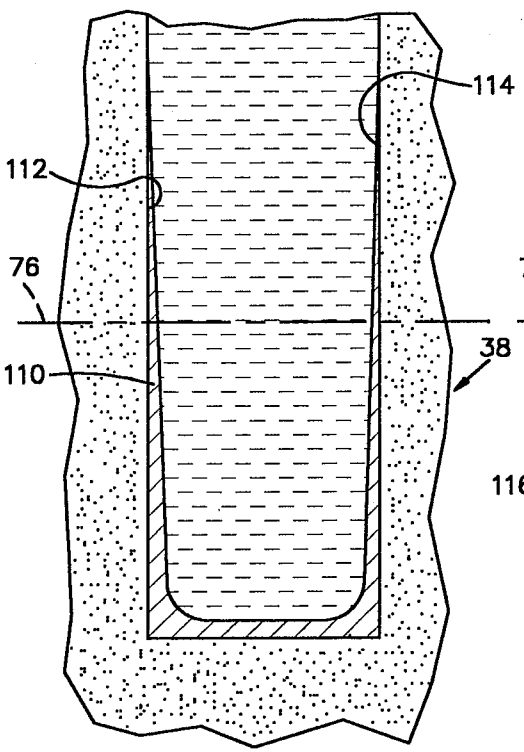
FIG. 5 is a schematicized sectional view of an article mold cavity of the mold structure of FIG. 4 and illustrating the manner in which molten metal initially solidifies along a large majority of the surface area of the long thin portion of the article mold cavity.

As an article mold 38 is withdrawn from the furnace 68, a thin, discontinuous layer or skin 110 (FIG. 5) of equiaxed metal solidifies over a large majority of an inner side surface 112 of the long thin portion of an article mold cavity 114. Although it can only be hypothesized, it is believed that the thin layer 110 extends over all but the upper two to ten percent of the inner side surface 112 of the long thin portion of the article mold cavity 114. The metal layer 110 has an equiaxed grain structure (FIG. 3) with a maximum grain dimension of one-half of an inch or less. Of course, the inner side surface 112 of the long thin portion of the article mold cavity 114 and the metal layer 110 have a configuration which corresponds to the configuration of the long thin portion of the article to be cast, that is, the airfoil portion 16 of the vane 10.

As the mold structure 42 is withdrawn from the furnace 68 (FIG. 4) into the vacuum chamber, dendrites grow inwardly and upwardly from the thin skin 110 extending over the side surface 112 (FIG. 5) of the long thin portion of the mold cavity 114. However, the thin skin or layer 110 does not initially extend over the single inlet to the article mold cavity 114. Therefore, molten metal can be fed from a runner 48 into an article mold cavity 114.

The closed lower end portion of each article mold 38 is disposed adjacent to the chill plate 60. The lower end portion of each article mold 38 is lowered from the furnace 68 into the relatively cool vacuum chamber. Therefore, dendrites grow upwardly from the thin skin 110 at a faster rate than they grow inwardly from the thin skin 110.

As an article mold 38 is withdrawn from the furnace 68, molten metal solidifies faster in the lower half 82 of the long thin portion of the article mold than in the upper half 84 of the long thin portion article mold. This is due to the combined effect of: preheating the lower half 82 to a lower temperature than the upper half 84, having the closed lower end of the article mold adjacent to the chill plate 60, and withdrawing the lower end portion of the article mold 38 from the furnace 68 into the relatively cool environment of the vacuum chamber surrounding the furnace 68. Therefore, the molten metal in the article mold cavity 114 solidifies, with an equiaxed grain structure, upwardly from the bottom of the mold cavity at a greater rate than it solidifies inwardly from the upright sides of the article mold cavity.

Figure 6:
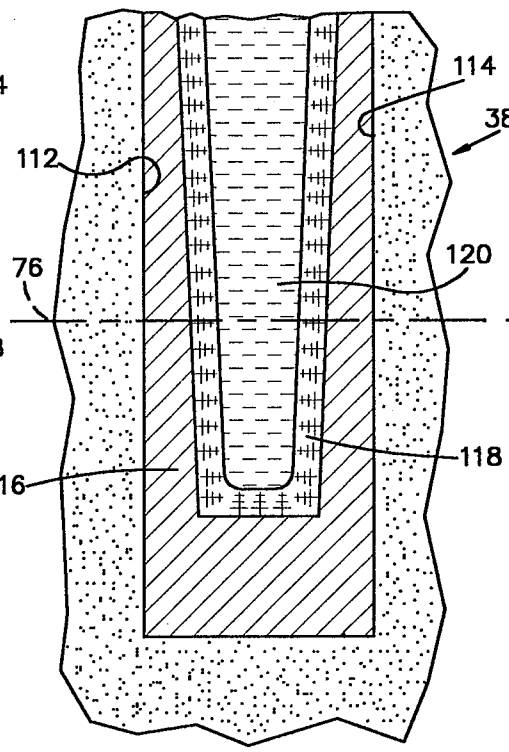
FIG. 6 is a schematic sectional view, generally similar to FIG. 5, illustrating the manner in which the molten metal simultaneously solidifies upwardly from the bottom of the long thin portion of the mold cavity and inwardly from the sides of the mold cavity.

As the molten metal solidifies in the long thin portion of the article mold cavity 114 (FIG. 6), a solid zone 116 is formed at the lower end and along the sides of the long thin portion of the article mold cavity. A mushy zone 118 (FIG. 6) of partially molten, partially solidified metal is located inwardly of the solid zone 116. A liquid zone 120 is located inwardly of the mushy zone 118 and is disposed along the central axis of the long thin portion of the article mold cavity 114. The liquid zone 120 extends upwardly to the opening to a runner or gate 48.

Figure 7:
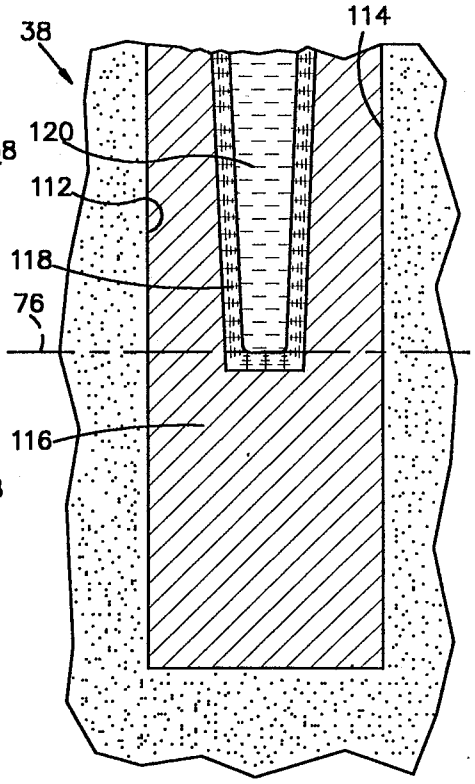
FIG. 7 is a schematic sectional view, generally similar to FIG. 6, illustrating the manner in which the molten metal solidifies in the lower portion of the long thin portion of the article mold cavity before the metal solidifies in the upper portion of the article mold cavity.

Although dendrites will extend from the thickening layer of solidified metal on the upright sides of the long thin portion of the article mold cavity 114 into the mushy zone 118, molten metal can be fed from a runner 48 into the mushy zone to compensate for shrinkage as the molten metal in the mold cavity 114 solidifies. As solidification continues, the size of the mushy zone 118 decreases (FIG. 7) and the amount of solidified molten metal in the lower half of the long thin portion of the article mold cavity 114 increases. Due the effect of the relatively cold chill plate 60, the relatively hot molten metal in the pour cup 46 and runner 48 and the temperature gradient established during preheating of the mold, the shrinking mushy zone 118 moves upwardly along the vertical longitudinal central axis of the long thin portion of the article mold cavity 114.

As the article mold 38 continues to be withdrawn from the furnace 68, the mushy zone 118 will move upwardly at a greater rate than it moves inwardly from the upright sides of the long thin portion of the article mold cavity 114. This enables the molten metal to solidify in the article mold cavity without the formation of voids or other defects. When solidification of the molten metal in the lower half of the long thin portion of the article mold cavity has been completed the solidification of the molten metal in the upper half of the long thin portion of the article mold cavity will not have been completed. However, when solidification of the molten metal in the lower half of the long thin portion of the article mold cavity has been completed, the majority of the molten metal in the upper half of the long thin portion of the article mold cavity will have solidified. It is estimated that when solidification of the molten metal in the lower half of the long thin portion of the article mold cavity is completed, approximately seventy to eighty five percent of the molten metal in the upper half of the long thin portion of the article mold cavity will have solidified.

Solidification progresses from the lower end of the long thin portion of the article mold cavity 114 to the upper end of this portion of the mold cavity. The feeding of molten metal to compensate for shrinkage occurs along the central axis of the article as the metal solidifies. This technique controls solidification such that it keeps open a central channel 120 inside the solidified metal 116 through which molten metal can feed from top runners 48 to compensate for solidification contraction occurring in remote lower sections.

This technique also actively promotes the availability of transverse secondary interdendritic channels for required lateral feeding of solidifying sections. Transverse interdendritic feeding depends primarily on the length of the interdendritic channels, which are generally determined by the dimensions of the mushy zone 118. Since the width of the mushy zone 118 is inversely related to the prevailing temperature gradients, the positive temperature gradients continually reduce the width of the mushy zone in the solidifying sections and thereby promote effective interdendritic lateral feeding.

As soon as withdrawal of the article mold from the furnace 68 is commenced, it is preferred to have the flow of electrical energy to the furnace coils 90, 92 and 94 (FIG. 4) interrupted. However, the flow of current to the lower coil 94 may only be reduced as the mold 42 moves out of the furnace 68. The amount of electrical energy conducted to the coil 92 may be reduced to a lesser extent. The amount of electrical energy conducted to the coil 90 may be maintained greater than the amount of electrical energy conducted to the coil 92. Regardless of how the coils 90, 92 and 94 are energized, the metal in the pour cup 46 and runners 48 is maintained at least partially molten as the metal in the article molds 38 solidifies.

After the mold structure 42 has been completely withdrawn from the furnace 68, the mold structure and the metal therein is cooled and the ceramic material of the mold removed from the solidified metal. The metal which solidified in the article molds 38 will have an equiaxed grain structure and an overall configuration which corresponds to the configuration of the vane 10. Since there are no gates to supply molten metal to the article mold cavity 114 at locations along the longitudinal central axis of the article mold cavity, the long thin airfoil 16 of the cast vane 10 will be free of gating material. Of course, long thin metal articles other than the vane 10 could be cast with an equiaxed grain structure by using the foregoing method.

Casting a Nickel Chrome Superalloy Vane

The vane 10 of FIGS. 1 and 2 is advantageously formed of a nickel chrome superalloy, such as IN-713C or Rene 77 having a solidus temperature of more than 2,250° F. The article molds 38 are preheated so that the lower half 82 of the long thin portion of each article mold 38 has an average temperature of less than 2,250° F. The upper half 84 of the long thin portion of each article mold 38 is heated to an average temperature of more than 2,000° F. and less than 2,500° F. The molten nickel chrome superalloy is heated to a temperature above 2,400° F. before being poured.

In one specific instance, the vane 10 was formed of Rene 77 having a liquidus temperature of 2,450° F. and a solidus temperature of 2,310° F. The mold structure 42 was preheated so that the closed lower ends of the article molds 38 were at a temperature of approximately 1,850° F. and the upper ends of the article molds were at a temperature of approximately 2,250° F.

The molten Rene 77 was poured at a temperature of 2,650° F. The mold face coat contained 10% by weight of cobalt aluminate inoculant to promote nucleation. When the mold had been heated to have a temperature gradient which ranged from 1,850° F. at the lower ends of the long thin portions of the article molds 38 to 2,250° F. at the upper ends of the long thin portions of the article molds, the molten metal was poured into the pour cup 46.

The molten metal ran through the runners 48 into the article mold cavities 38. As the article molds 38 were filled with molten metal, it is believed that nucleation occurred at various locations along approximately 95% of the longitudinal extent of the long thin portion of the article mold cavity. As soon as the article mold cavities 38 were filled with molten metal, the chill plate 60 was lowered to begin withdrawal of the mold structure 42 from the furnace 68 at a rate of 60 inches per hour. As the mold structure 42 started to be withdrawn from the furnace 68, the electrical energy supplied to the coils 90, 92 and 94 was interrupted.

The vane 10 was cast without any gating along the longitudinal extent of the article mold cavity. The vane 10 had an equiaxed grain structure, similar to the grain structure shown in FIG. 3, and was free of defects. This specific vane had a grain size which was coarser than, but close to, an ASTM grain standard grain size No. 1. None of the surface grains had a maximum dimension of more than one-fourth of an inch.

Metal Article—Second Embodiment

In the embodiment of the metal article 10 illustrated in FIGS. 1 and 2, the lower portion 14 of the article 10 is relatively small and solidifies without forming defects in the adjacent long thin portion of the article. However, through experience, it has been learned that when the lower portion 14 is enlarged so as to have a relatively thick or heavy projection and is cast in the manner previously described, the article 10 solidifies with defects adjacent to and/or at the interconnection between the long thin portion 16 and lower portion.

Figure 8:
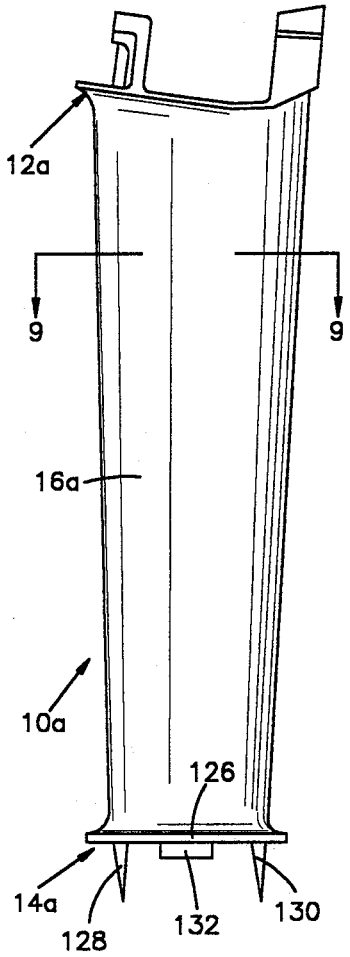
FIG. 8 is an elevational view, generally similar to FIG. 1, of another metal article having a long thin portion.
Figure 9:
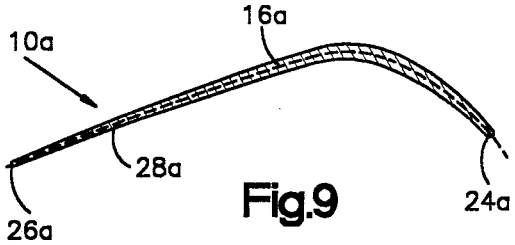
FIG. 9 is a sectional view, taken generally along the line 9—9 of FIG. 8, further illustrating the configuration of the long thin portion of the metal article.
Figure 10:
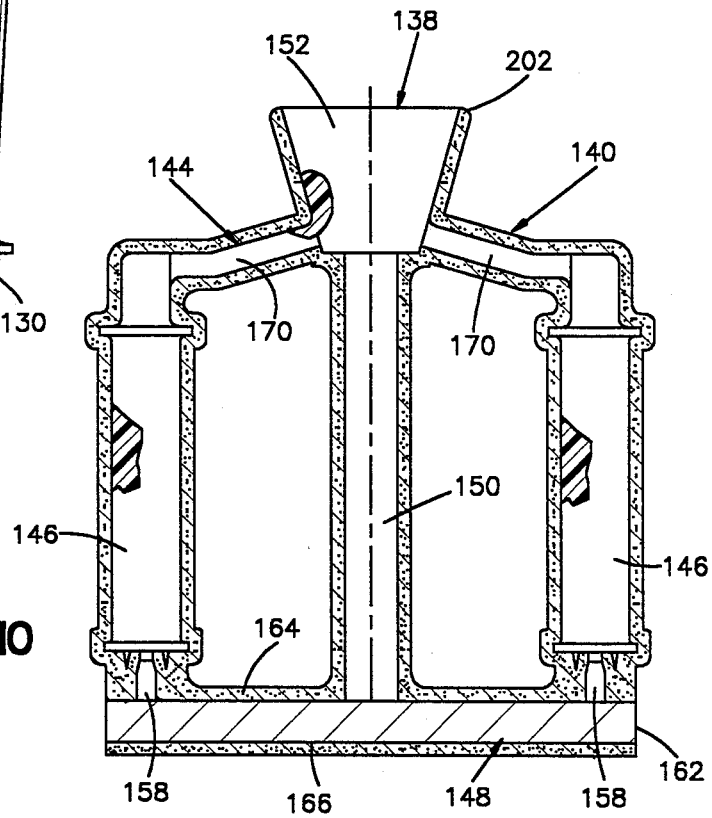
FIG. 10 is a schematicized sectional view of a pattern with a layer of ceramic mold material around the pattern.

In the embodiment of the cast article illustrated in FIGS. 8 and 9, a long thin portion of the article is connected with an enlarged lower portion which is relatively heavy or massive. The article of FIGS. 8 and 9 and the method by which it is cast are generally similar to the article of FIGS. 1 and 2 and the method by which it is cast. Therefore, numerals similar to those used in conjunction with FIGS. 1–7 will be used in conjunction with FIGS. 8–14, the suffix letter "a" being added to the numerals in FIGS. 8–14 to avoid confusion.

The article **10*a* of FIGS. 8 and 9 has a long thin portion and an enlarged end portion. Although the present invention could be utilized to cast many different articles, the article 10*a* is a turbine engine component, specifically, a vane formed of a nickel chrome superalloy having an equiaxed grain structure. The vane or metal article 10*a* has an upper shroud portion 12*a* and an enlarged lower shroud portion 14*a*. A long thin airfoil portion 16*a*** extends between and is cast as one piece with the upper and lower shroud portions.

With the exception of the lower shroud portion **14*a*, the vane 10*a* has approximately the same dimensions as the airfoil 10 of FIGS. 1 and 2. Thus, the vane 10*a* has an airfoil portion 16*a* with a length of approximately 7 inches. The airfoil portion 16*a* of the vane 10*a* has a width of approximately 2.5 inches. The distance between the leading edge portion 24*a* (FIG. 9) of the vane 10*a* and a trailing edge portion 26*a* of the vane, as measured along a central axis 28*a*, is approximately 2.5 inches. Since the airfoil portion 16*a* of the vane 10*a* has a slight longitudinal taper, the distance between the leading and trailing edge portions 24*a* and 26*a* varies along the length of the vane. The airfoil portion 16*a* of the vane has a maximum thickness of approximately 0.080 inches. The airfoil portion 16*a* of the vane 10*a* gets thinner toward the leading and trailing edge portions 24*a* and 26*a***.

The airfoil portion 16a of the vane 10a is a long thin article. Thus, the airfoil portion 16a of the vane 10a has a length (FIG. 8) of more than four inches. The length of the airfoil portion 16a of the vane 10a is also at least 20 times the thickness of the airfoil portion. Therefore, the airfoil portion 16a of the vane 10a meets the requirements for what is and has been referred to herein as a long thin article.

The lower shroud portion 14a of the vane 10a has a generally rectangular platform 126. The platform projects transversely outwardly from the airfoil portion 16a. A pair of thin outer rails or projections 128 and 130 extend downwardly from the platform 126. A thick central rail 132 is disposed between the thin outer rails 128 and 130.

In the embodiment of the metal article 10a illustrated in FIGS. 8 and 9, the two outer rails 128 and 130 each have a length of approximately 1.3 inches. The thin outer rails have a triangular cross sectional configuration with a height, as measured from the platform 126 downwardly to the peak, of 0.2 inches and a base, as measured along the platform 126, of 0.05 inches. The central rail 132 extends parallel to the outer rails 128 and 130 has a length of approximately 1.3 inches, a height, as measured downwardly from the platform 126, of approximately 0.1 inches and a width, as measured along the platform 126, of approximately 0.2 inches. Thus, the mass of the central rail 132 is approximately four times the mass of either one of the outer rails 128 and 130. It should be noted that the outer rails 128 and 130 have a relatively large surface area per unit of mass.

It should be understood that the foregoing specific dimensions for the particular metal article or vane 10a illustrated in FIGS. 8 and 9 have been set forth herein for purposes of clarity of description and not for purposes of limitation of the invention. Thus, it is contemplated that the airfoil portion 16a and/or enlarged shroud portion 14a could be constructed with substantially different dimensions if desired. In addition, it is contemplated that the airfoil portion 16a and/or shroud portion 14a could have a substantially different configuration from the illustrated configuration. For example, the shroud portion 14a could be constructed with a pair of relatively heavy outer rails in place of the thin outer rails 128 and 130 and the heavy central rail 132 could be omitted. Thus, the specific configuration and size of the vane 10a should be considered as being merely illustrative.

By experimentation, it has been determined that when the metal article or vane 10a is cast using the method described in conjunction with the embodiment of the invention illustrated in FIGS. 1–7 herein, defects occur in the long thin airfoil portion 16a and/or the platform 126 at a location adjacent to the interconnection between the airfoil portion and shroud portion 14a. It is believed that the relatively heavy mass of the central rail 132 alters the thermal gradiants in a manner which causes the metal to solidify in the mold with defects.

By experimentation, it has also been determined that the use of a chill in association with relatively heavy or massive shroud rails, such as the central rail 132, eliminates the defects when the vane 10a is cast by using the method previously described in conjunction with FIGS. 1–7 herein. Thus, a chill is exposed to the molten metal which enters the portion of the mold in which the relatively heavy central rail 132 is formed. This causes the molten metal in the central rail forming portion to initially solidify at a greater rate than the remainder of the vane 10a.

It is believed that this relatively high initial rate of solidification of molten metal in the rail forming portion of the mold results in a minimization of the effect of the central rail forming portion on the thermal gradiants. Thus, it is believed that the chill results in the platform 126 and metal in the lowermost part of the long thin airfoil portion 16a solidifying in much the same manner as if the relatively thick central rail 132 had been eliminated. It is believed that the mass of the relatively thin outer rails 128 and 130 is insufficient to effect the manner in which the molten metal solidifies in the platform 126 and lowermost part of the long thin airfoil portion 16a.

Regardless of the reasons, it has been determined that when a chill is used for the molten metal in the relatively thick central rail 132, the vane or metal article 10a solidifies without any defects. The solidification of the molten metal in the portion of the article mold cavity which forms the long thin airfoil portion 16a occurs in the same manner as illustrated and previously described in conjunction with FIGS. 5–7 herein when a chill is used in association with the heavy central rail 132. It is not necessary to use chills with the light outer rails 128 and 130.

If the shroud portion 14a had a substantially different configuration, a different chill arrangement would be used. For example, if the shroud portion 14a of the vane 10a had a pair of relatively heavy outer rails and did not have a central rail, a chill would be used for each of the relatively heavy outer rails. Thus, a vane having the same general construction as illustrated in FIG. 8 with the exception that there were two massive outer rails in place of the thin rails 128 and 130 and no central rail, corresponding to the rail 132, was cast using a pair of chills, that is one chill for each rail. The resulting vane was free of defects.

It should be understood that the present invention can be used to cast long thin articles other than the vane 10a. In fact, certain features of the invention can be used in the casting of articles which do not have portions with a long thin configuration. However, it is believed that the features of the present invention are advantageously combined to enable long thin articles to be cast without gating at locations between opposite ends of the articles.

Mold Structure

In accordance with known practices, a wax pattern 138 (FIG. 10) is used to form an improved mold structure 140. The wax pattern 138 may be formed of either natural or artificial wax. The mold structure pattern 138 includes a gating system pattern 144, a plurality of article patterns 146 which are connected with and supported by a base plate. The article patterns 146 have a configuration which corresponds to the configuration of the vane 10a of FIGS. 8 and 9. A solid ceramic support post 150 extends between a wax pour cup pattern section 152 in the gating system 144 and the base 148.

In addition to the foregoing, a pattern assembly 138 constructed in accordance with the present invention includes wax chill patterns 158 which are disposed at the lower ends of the article patterns 146. The wax chill patterns 158 have a configuration which is the same as the configuration of chills which are to be subsequently used in association with the casting of the metal articles 10*a*. It should be understood that although only two article patterns 146 have been shown in FIG. 10, a plurality of article patterns are disposed in an annular array about the central axis of the pattern. The upper ends of the article patterns are all connected with the gating system pattern 144. There is a chill pattern 158 connected to the lower end of each of the article patterns 146 and to the upper side surface of the circular base plate 148.

The entire wax pattern 138 is repetitively dipped in a slurry of ceramic mold material and stuccoed to build up a layer of mold material over the pattern. Each time the pattern 138 is dipped, a cylindrical outer side surface 162 on the base plate 148 is wiped to remove the mold material from the side surface of the plate. This results in a separation between circular base 164 of the mold structure 140 and a circular layer 166 of mold material on the bottom of the pattern plate 148.

After the wax pattern 138 has been dipped for a number of times sufficient to build up a layer of ceramic mold material having a desired thickness over the pattern, the layer of ceramic mold material is dried. The pattern base plate 148 is separated from the base 164 of the mold structure 140. The wax pattern material is then melted and removed from the ceramic layer by the use of heat and/or chemical solutions. The ceramic mold material is then fired to give it the requisite strength and complete the process of forming the mold structure.

The foregoing process of making the mold structure 140 is well known. However, it should be noted that the wax pattern 138 and the resulting mold structure 140 does not have any provision for gating passages to side portions of the article patterns 146. The article patterns 146 have the same configuration as the vane 10*a* of FIG. 8. The long thin portion of the article pattern 146 corresponding to the airfoil 16*a* is completely free of any passages for conducting metal. The only provision for metal conducting passages are in the wax pattern of the gating system 144. Thus, the gating system pattern 144 includes a plurality of runner patterns 170 which extend radially outwardly from the frustoconical pour cup pattern 152 to the upper ends of the article mold patterns 146.

After the wax pattern 138 has been removed from the mold structure 140 with known techniques, the one piece ceramic mold structure 140 (FIG. 11) is complete with a plurality of article molds 38*a* disposed in an annular array about a pour cup 46*a*. The article molds 38*a* have article mold cavities 114*a* with the same configuration as the vane 10*a*. The article mold cavities 114*a* are divided into a lower half 82*a* and upper half 84*a* by an imaginary horizontal plane 76*a* which extends through centers of the long thin portions of the article molds 38*a*. The upper end of the article mold cavity 114*a* is connected in fluid communication with the pour cup 46*a* by a runner 48*a*. The lower end of the article mold 38*a* is connected with the circular base plate 164.

The article mold cavity 114*a* includes a long thin airfoil forming portion 174 having a configuration corresponding to the configuration of the airfoil 16*a* (FIGS. 8 and 9). In addition, the article mold cavity 114*a* (FIG. 11) includes a shroud forming portion 176. The shroud forming portion 176 of the article mold cavity 114*a* includes a platform forming portion 178 having a configuration corresponding to the configuration of the platform 126 (FIG. 8).

A pair of thin outer rail forming portions or cavities 180 and 182 extend downwardly from the platform forming portion 178. The outer rail forming portions 180 and 182 have configurations corresponding to the configurations of the outer rails 184 and 130 of FIG. 8. A central rail forming portion or cavity 128 (FIG. 11) extends downwardly from the platform forming portion 178 at a location midway between the outer rail forming portions 180 and 182. The central rail forming portion 184 has a configuration corresponding to the configuration of the central rail 132.

A chill receiving pocket 186 is disposed immediately beneath the central rail forming portion 184 and has a vertical central axis which is aligned with a central axis of the long thin airfoil forming portion 174 of the mold. The chill receiving pocket 186 has an upper opening 188 which connects the chill receiving pocket 186 with the central rail forming portion 184.

The opening 188 has a configuration corresponding to the configuration of a desired area of exposure of a central rail portion of the article mold to a chill during casting of the vane 10*a*. In addition, the chill receiving pocket 186 has a lower opening 190 through which a chill can be inserted into the pocket. The specific pocket 186 illustrated in FIG. 11 has a circular lower opening 190 and a smaller, rectangular upper opening 188. The pocket 186 itself has a configuration which corresponds to the configuration of a chill which is to be inserted into the pocket.

The upper opening 188 allows molten metal in the central rail forming portion 184 to engage a chill in the pocket 186. However, if it was desired to prevent engagement of the molten metal with the chill, the upper end of the pocket 186 could be closed.

Figure 11:
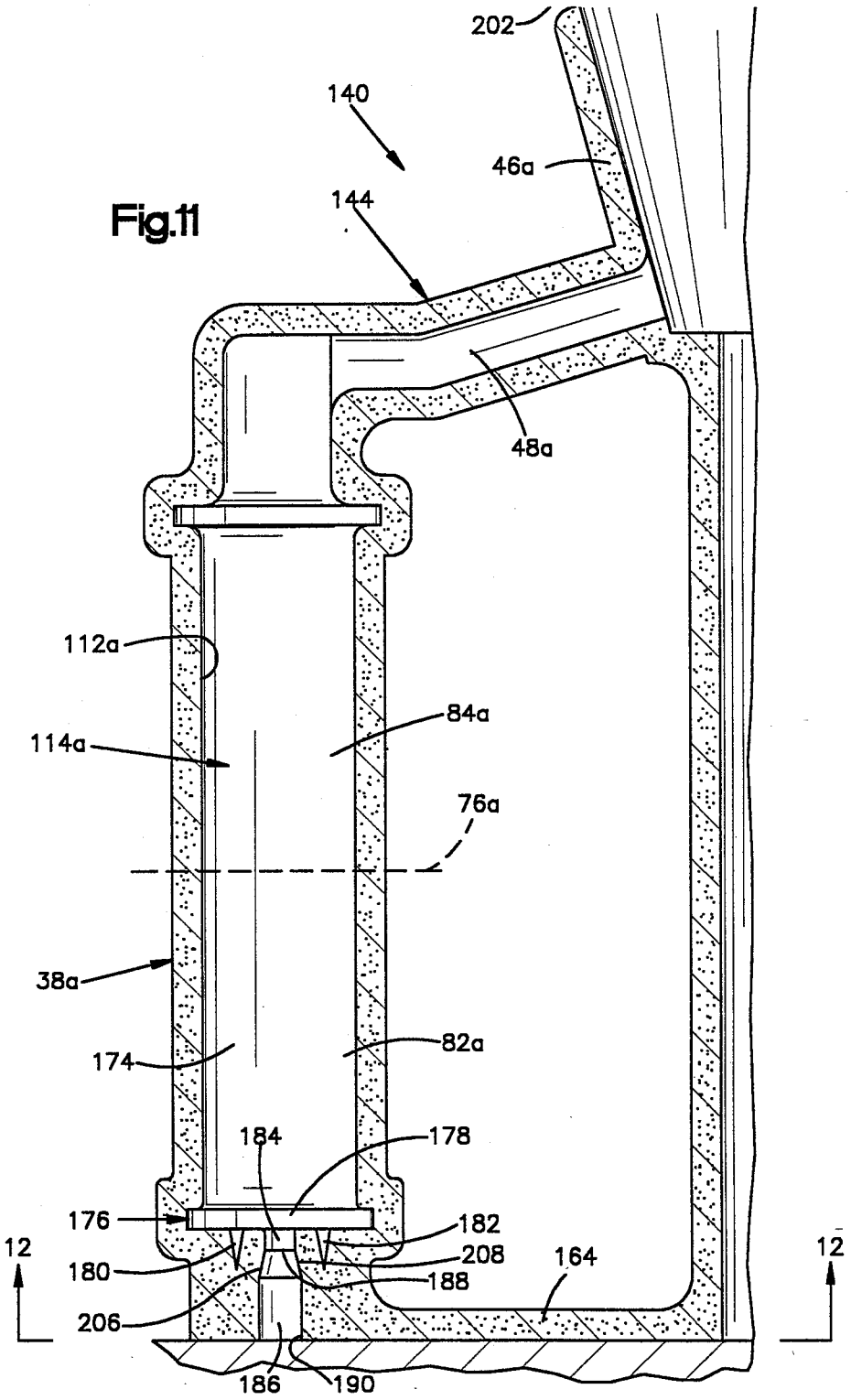
FIG. 11 is an enlarged fragmentary sectional view of a portion of a mold structure formed by the layer of ceramic mold material of FIG. 10 after the pattern has been removed.

Although only a single chill receiving pocket 186 has been illustrated in FIG. 11, it should be understood that there is an annular array of chill receiving pockets 186 (FIG. 12) formed in the circular base plate. In the embodiment of the invention illustrated in FIG. 12, there are twenty chill receiving pockets formed in the base plate. Each of the chill receiving pockets is associated with an article mold 38*a*. The flat circular bottom surface 192 of the base plate 164 (FIG. 12) is formed with a circular array of openings 190 through which chills are inserted into the pockets 186.

Chills having a generally cylindrical configuration are to be inserted into the pockets 186. Therefore, the openings 190 in the base plate 164 are circular. However, if rectangular chills were to be used, a chill receiving pocket 186 would have a rectangular cross sectional configuration and the base plate openings 190 would be similarly configured.

Positioning Chills

When the mold structure 140 is to be used to cast the vanes 10*a* in the article molds 38*a*, chill members 196 (FIG. 13) are inserted into the pockets 186. The chill member 196 includes a cylindrical body portion 198 having a flat end surface 200. The flat end surface 200 is formed with a generally rectangular configuration by grinding away the sides of a cylindrical metal slug.

The specific dimensions of the chill member 198 are a function of dimensions of the article or portion of an article with which the chill member is to be used. A chill for the central rail 132 (FIG. 8) of the vane 10*a* had a rectangular side surface 200 (FIG. 13) with a width corresponding to the width of the central rail 132, that is 0.2 inches. The flat surface 200 had a length which corresponds to the diameter of the body portion 198 of the chill member 196. Although the central rail 132 in the illustrated embodiment of the vane 10 had a length of 1.3 inches, the chill member 196 had a diameter of 0.35 inches. Thus, the length of the upper surface 200 on the chill member 196 is less than ⅓ of the length of the central rail 132 on the vane 10*a*. The upper chill pocket opening 188 is of the same size and configuration as the chill surface 200.

It should be understood that the foregoing dimensions for the chill 196 have been set forth herein merely for purposes of clarity of description and that chill members having a different size and/or configuration could be used if desired. In addition, it should be understood that the relationship between the size of the surface 200 on the chill member to the size of the central rail 132 may be different than the specific relationship set forth herein. For example, the length of the upper chill surface could be equal to the length of the rail 132 if desired.

Figure 12:
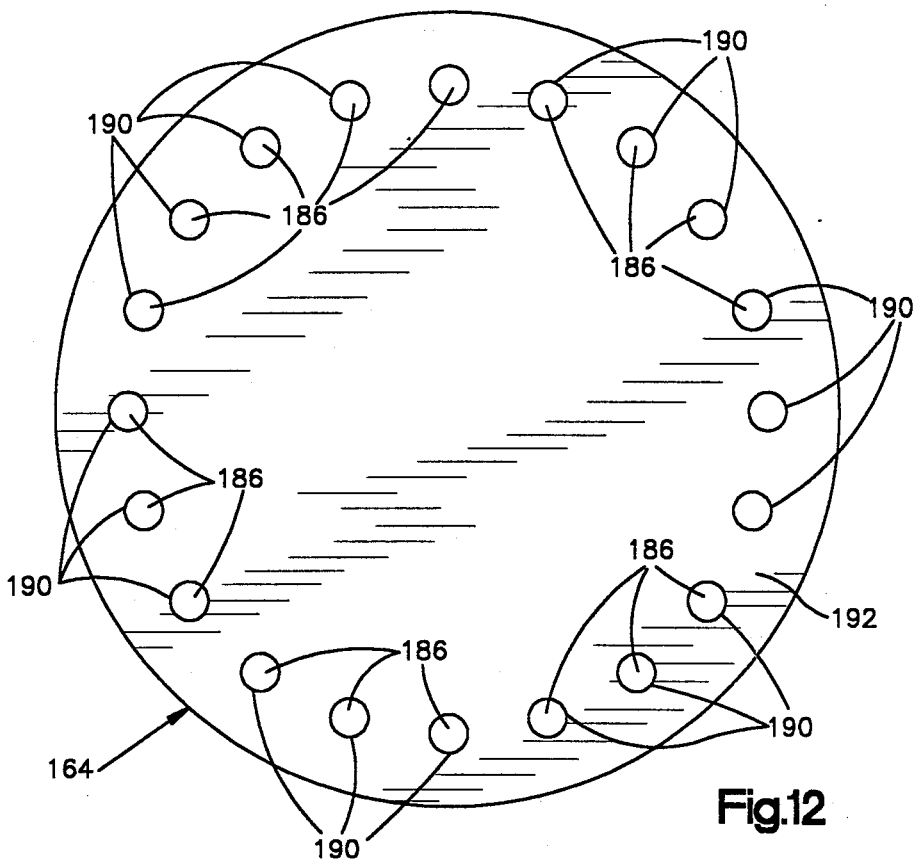
FIG. 12 is a plan view taken generally along the line 12—12 of FIG. 11 on a reduced scale and illustrating a circular array of openings formed in a base plate to provide access to chill receiving pockets.
Figure 13:
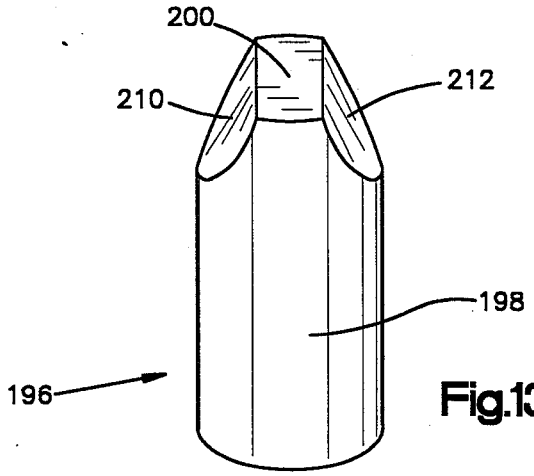
FIG. 13 is an enlarged illustration of a chill which is received in a pocket of the mold of FIG. 12.

When the mold structure 140 is to be used to cast a plurality of vanes 10*a*, the mold structure is first turned up-side-down so that the bottom surface 192 of the base plate 164 faces upwardly to expose the openings 190 to the pockets 186 (FIG. 12). When the mold structure is in the up-side-down orientation, the mold structure may be supported on the pour cup 46*a*. Thus, a circular rim 202 (FIG. 11) on the pour cup 46*a* engages a support surface. The longitudinal central axes of the article mold cavities 114*a* are disposed in a vertical orientation. The gating system 144 is disposed beneath the base plate 164 rather than above the base plate as shown in FIG. 11.

With the mold structure 140 in an up-side-down orientation (FIG. 12), it is a relatively easy matter to insert a chill member 196 into each of the pockets 186. The pockets 186 are sized to grip the outer side surfaces of the chill members 196 to hold them in the pockets. However, a suitable adhesive, such as glue, ceramic mold slurry, or wax, may be used to hold the chill members 196 in the pockets. Thus, a small dab or tack of pattern wax is used to connect the chill members 196 with the base plate 164 of the mold structure 140.

The chill members 196 project out of the pockets 186 for a short distance. Thus, the chill members 196 have an axial extent which is slightly greater than the axial extent of the pockets 186. This results in a cylindrical end portion of each of the chill members projecting out of the pockets 186 for a short distance. In one specific embodiment of the invention, the chill members projected out of the pockets 186 for a distance of approximately 0.1 inches. However, it should be understood that the chill members 196 could be sized to fit completely into the pockets 186 or to project from the pockets for either a greater or lesser distance if desired.

Figure 14:
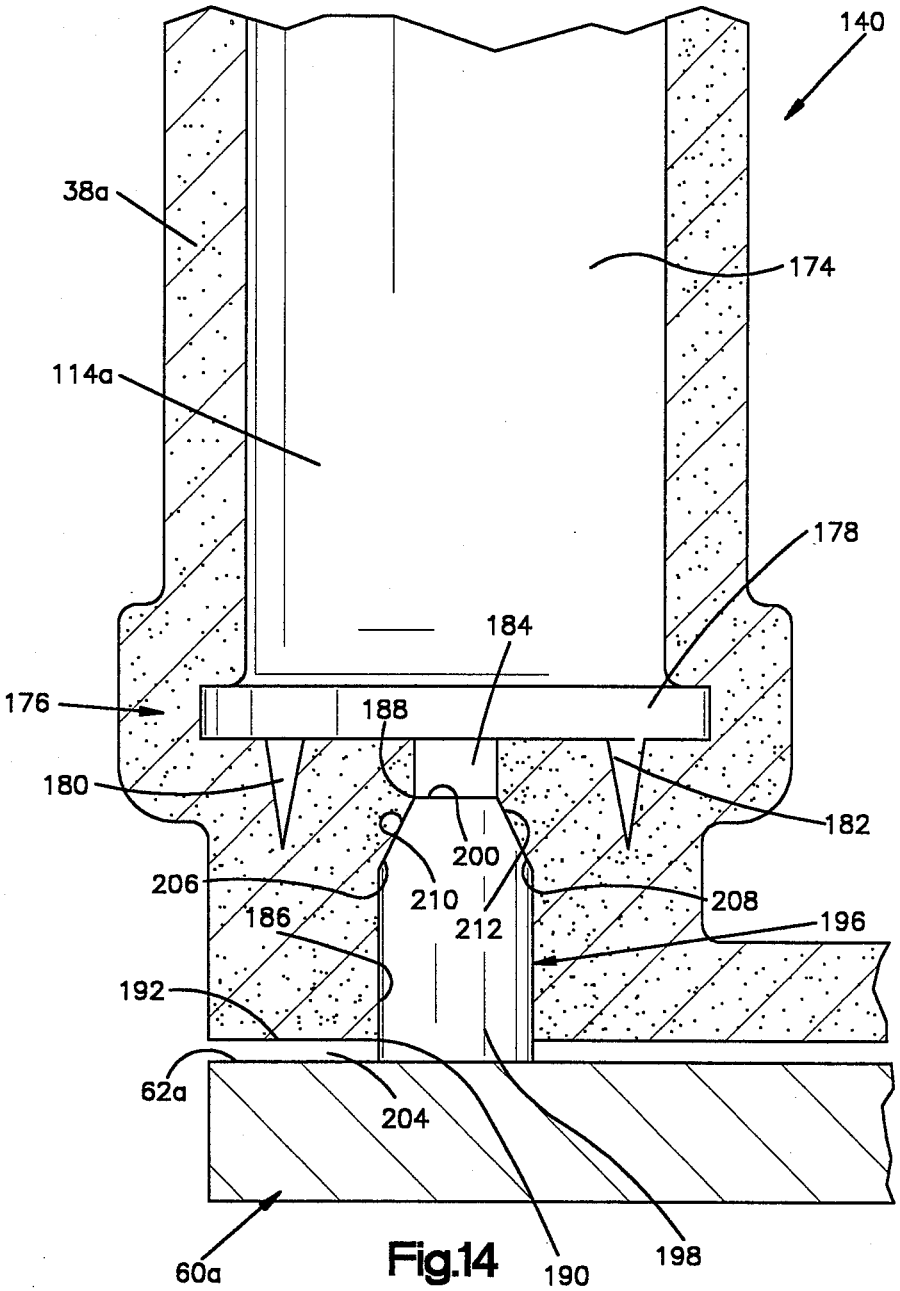
FIG. 14 is a fragmentary schematic illustration depicting the manner in which a mold structure is supported above a chill plate on a chill member.

Once the chill members 196 have been positioned in the pockets 186, the mold is turned back over, that is to a right-side-up orientation in which the gating system 144 is disposed above the base plate 164 (FIG. 11). The mold structure 140, with the chills 196 in the pockets 186 is then placed on a circular water cooled chill plate 60*a* (FIG. 14). When the mold structure 140 is placed on the chill plate 60*a*, the lower ends of the chill members 196 engage the chill plate 60*a* and support the mold structure 140 above the chill plate. As metal solidifies in the article mold 38*a*, heat is transmitted through the chill members 196 to the chill plate 60*a*.

A small gap 204 (FIG. 14) is provided between the circular bottom surface 192 of the base plate 164 of the mold structure 140 and the circular upper side surface 62*a* of the chill plate 60*a*. The size of the gap 204 will depend upon the distance for which the chill members 196 extends from the pockets 186. However, since the chill members 196 all extend for the same distance from the pockets 186, there will be a uniform gap or space 204 between the bottom of the mold structure 140 and the top of the chill plate 60*a*.

Since the mold structure 140 is supported on the chill members 196, tapered inner side surfaces 206 and 208 of the pocket 186 (FIG. 14) are pressed against similarly shaped side surfaces 210 and 212 (FIG. 13) on the chill members 196. This results in the ceramic material of the mold structure 140 being pressed against the metal chill members 196 to form a fluid tight seal at the opening 188 leading to the central rail forming portion 184 of the article mold cavity 114*a* (FIG. 14). In addition, the weight of the mold structure 140 presses the chill members 196 against the water cooled chill plate 60*a* to facilitate the transfer of heat from the chill members to the chill plate. This results in the chill members 196 functioning as upward extensions of the chill plate 60*a*. If desired, the periphery of the base plate 164 of the mold structure 140 can be clamped or otherwise connected to the chill plate 60*a* once the mold structure 140 has been positioned on the chill plate.

Casting of Articles

After the mold structure 140 has been positioned on the chill plate 60*a*, the chill plate is raised into a furnace (not shown) which is evacuated. The furnace then preheats the mold structure 140 in a non-uniform manner. Thus, there is a temperature gradient which increases from a low temperature at the lower ends of the shroud forming portions 176 of the article molds 38*a* to a higher temperature at the upper ends of the airfoil forming portions 174 of the article molds. The lower halves 82*a* (FIG. 11) of the article mold cavities 114*a* in which the long thin airfoil portions 16*a* of the vanes 10*a* are cast, are heated into a first temperature range. The lower ends of the shroud forming portions 176 are at the lowest temperature in the first temperature range. The highest temperature in this first temperature range is close to but is less than the solidus temperature of the metal of the vane 10*a*.

The upper half of the long thin portion of the article mold cavity 114*a* in which the airfoil portion 16*a* of the vane 10*a* is cast is heated into a second temperature range. The second temperature range contains temperatures which are higher than the temperatures in the first range. Since the upper and lower halves 82*a* and 84*a* of the long thin portion of the article mold cavity 114*a* are separated by only an imaginary plane 76*a*, the lowest temperature in the second temperature range into which the upper half 84*a* is heated is the same as the highest temperature of the temperature range into which the lower half 82*a* is heated. The lower end of the shroud forming portion 176 of the preheated article mold 38*a* is at a temperature which is approximately 500° F. less than the temperature of the upper end of the long thin portion of the article molds.

Once the article molds 38*a* have been preheated, molten metal is poured into the pour cup 46*a*. This molten metal is conducted by the gating system 144 (FIG. 11) into the article mold cavity 114*a*. The molten metal flows through the article mold cavity 114*a* into the shroud forming portion 176 of the article mold cavity. Thus, the rail forming portions 180, 182 and 184 of the article mold cavity 114*a* are filled with molten metal. Due to their very thin configuration, the molten metal in the outer rail forming cavities 180 and 182 quickly solidifies. Due to the chill 196, the molten metal in the central rail forming cavity 184 quickly solidifies.

The molten metal in the central rail forming cavity 184 is exposed to the upper side surface 200 of the chill 196 at the opening 188 in the bottom of the rail forming cavity. Since the upper side surface 200 of the chill 196 is relatively cool, the molten metal solidifies at a very high rate without forming a metallurgical bond between the molten metal and the chill 196. Thus, the molten metal in the central rail forming cavity 184 is solidified on the upper side surface 200 of the chill 196 before the metal of the chill is melted. As the molten metal solidifies, heat is transmitted through the chill 196 to the chill plate 60*a*. This results in solidification of the molten metal in the central rail forming portion 184 at a faster rate than in the remainder of the shroud forming portion 176 of the article mold cavity 114*a*.

The relatively high rate of solidification of the metal in the central rail forming portion 184 enables the mass of molten metal in the central rail forming portion to solidify in the same time period that a smaller mass of metal would solidify without the chill 196. Although it is not known for certain, it is believed that this rapid solidification of the molten metal in the central rail forming portion 184 minimizes the effect of the metal in the central rail forming portion on the solidification of the remainder of the shroud portion 176 and the lower end of the long thin airfoil forming portion of the article mold cavity. In any event, it has been determined that, by the use of the chill 196, the formation of defects in the long thin airfoil portion 16*a* of the vane 10*a* adjacent to the platform 126 is eliminated.

Since seventy to one hundred percent of the length of each of the long thin portions of the article molds 38*a* in which the airfoils 16*a* are cast is below the solidus temperature of the molten metal, random nucleation occurs over almost the entire surface of each article mold cavity when the molten metal is poured into the article molds. Therefore, initiation of solidification of the molten metal occurs at locations which are disposed along at least the lower eighty to ninety percent of the long thin portion of each article mold cavity in which the airfoils 16*a* are cast and along the entirety of the shroud forming portion 176.

As soon as the article molds 38*a* are filled with molten metal, withdrawal of the mold structure 140 from the furnace begins. This is accomplished by lowering the chill plate 60*a* at a constant speed. However, the speed of withdrawal of the mold structure 140 could be varied as the mold is withdrawn from the furnace.

As an article mold 38*a* is withdrawn from the furnace, a thin, discontinuous layer or skin of equiaxed metal solidifies over a large majority of an inner side surface 112*a* (FIG. 11) of the long thin portion 174 of the article mold cavity 114*a* and over the entire inner side surface area of the shroud forming portion 176 of the article mold cavity. Although it can only be hypothesized, it is believed that the thin layer extends over all but the upper two to ten percent of the article mold cavity 114*a*. Thus, the thin metal layer extends across the entire surface of the shroud forming portion 176 and upwardly over a large majority of the surface of the long thin airfoil forming portion 174. Of course, the metal layer will have a thick portion over the upper surface 200 of the chill 196. The metal layer has an equiaxed grain structure (FIG. 3) with a maximum grain dimension of one-half of an inch or less.

As the mold structure 140 is withdrawn from the furnace, molten metal solidifies faster in the lower half 82*a* of the long thin portion 174 and the shroud portion 176 of the article mold than in the upper half 84*a* of the long thin portion of the article mold. Therefore, the molten metal in the article mold cavity 114*a* solidifies, with an equiaxed grain structure, upwardly from the bottom of the shroud forming portion 176 at a greater rate than it solidifies inwardly from the upright sides of the shroud portion 176 of the article mold cavity 114*a*.

The molten metal in the shroud forming portion 176 completely solidifies before the lowermost end of the airfoil forming portion 174 completely solidifies. Therefore, molten metal can be supplied to the shroud forming portion 176 from the long thin airfoil forming portion 174 throughout the entire time during which metal is solidifying in the shroud forming portion.

As the molten metal solidifies in the shroud portion 176 and in the long thin portion 174 of the article mold cavity 114*a*, a solid zone is formed at the lower end and along the sides of the shroud forming portion 176 of the article mold cavity. A mushy zone of partially molten, partially solidified metal is located inwardly of the solid zone. A liquid zone is located inwardly of the mushy zone and is disposed along the central axis of the long thin portion 174 of the article mold cavity. The liquid zone extends upwardly to the opening to a runner or gate 48*a*. As solidification continues, the size of the mushy zone decreases and the amount of solidified metal in the lower half of the long thin portion of the article mold cavity 114*a* increases. As the article mold continues to be withdrawn from the furnace, the mushy zone will move upwardly at a greater rate than it moves inwardly from the upright sides of the long thin portion of the article mold cavity 114*a*.

When solidification of the molten metal in the shroud portion 176 and the lower half of the long thin portion 174 of the article mold cavity 114*a* has been completed, the solidification of the molten metal in the upper half of the long thin portion of the article mold cavity will not have been completed. The feeding of molten metal to compensate for shrinkage takes place along the central axis of the long thin portion of the article mold cavity 114*a* as the metal solidifies. The manner in which the molten metal solidifies in the article mold cavity 114*a* is the same as was previously described in conjunction with the article 10 and illustrated in FIGS. 5–7.

Casting One Specific Vane 10*a*

The vane 10*a* of FIGS. 8 and 9 may be formed of a nickel chrome superalloy, such as IN-713C or Rene 77 having a solidus temperature of more than 2,250° F. The article molds 38*a* are preheated so that the lower half 82*a* of the long thin portion 174 of each article mold 38*a* and the shroud portion 176 has an average temperature of less than 2,250° F. The upper half 84*a* of the long thin portion of each article mold 38*a* is heated to an average temperature of more than 2,000° F. and less than 2,500° F. The molten nickel chrome superalloy is heated to a temperature above 2,400° F. before being poured.

In this one specific instance, the vane 10*a* was formed of Rene 77 having a liquidus temperature of 2,450° F. and a solidus temperature of 2,310° F. The mold structure 140 was preheated so that the shroud forming portions 176 of the article molds 38*a* were at a temperature of approximately 1,850° F. and the upper ends of the article molds were at a temperature of approximately 2,250° F.

The molten Rene 77 was poured at a temperature of 2,650° F. The mold face coat contained 10% by weight of cobalt aluminate inoculant to promote nucleation. When the mold had been heated to have a temperature gradient which ranged from 1,850° F. at the lower ends of the long thin portions of the article molds 38a to 2,250° F. at the upper ends of the long thin portions of the article molds, the molten metal was poured into the pour cup 46a.

The molten metal ran through the runners 48a into the article mold cavities 114a. As the article molds 38a were filled with molten metal, it is believed that nucleation occurred at various locations along approximately 95% of the longitudinal extent of the long thin portion of the article mold cavity and along the, entire shroud forming portion 176. As soon as the article mold cavities 114a were filled with molten metal, the chill plate 60a was lowered to begin withdrawal of the mold structure 140 from the furnace at a rate of 60 inches per hour. As the mold structure 140 started to be withdrawn from the furnace, the electrical energy supplied to the coils of the furnace was interrupted.

The vane 10a was cast without any gating along the longitudinal extent of the article mold cavity. The vane 10a had an equiaxed grain structure, similar to the grain structure shown in FIG. 3, and was free of defects. This specific vane had a grain size which was coarser than, but close to, an ASTM grain standard grain size No. 1. None of the surface grains had a maximum dimension of more than one-fourth of an inch. There were no defects at locations adjacent to the interconnection between the long thin airfoil portion 16a and shroud portion 14a.

Shroud Portion—Third Embodiment

Figure 15:
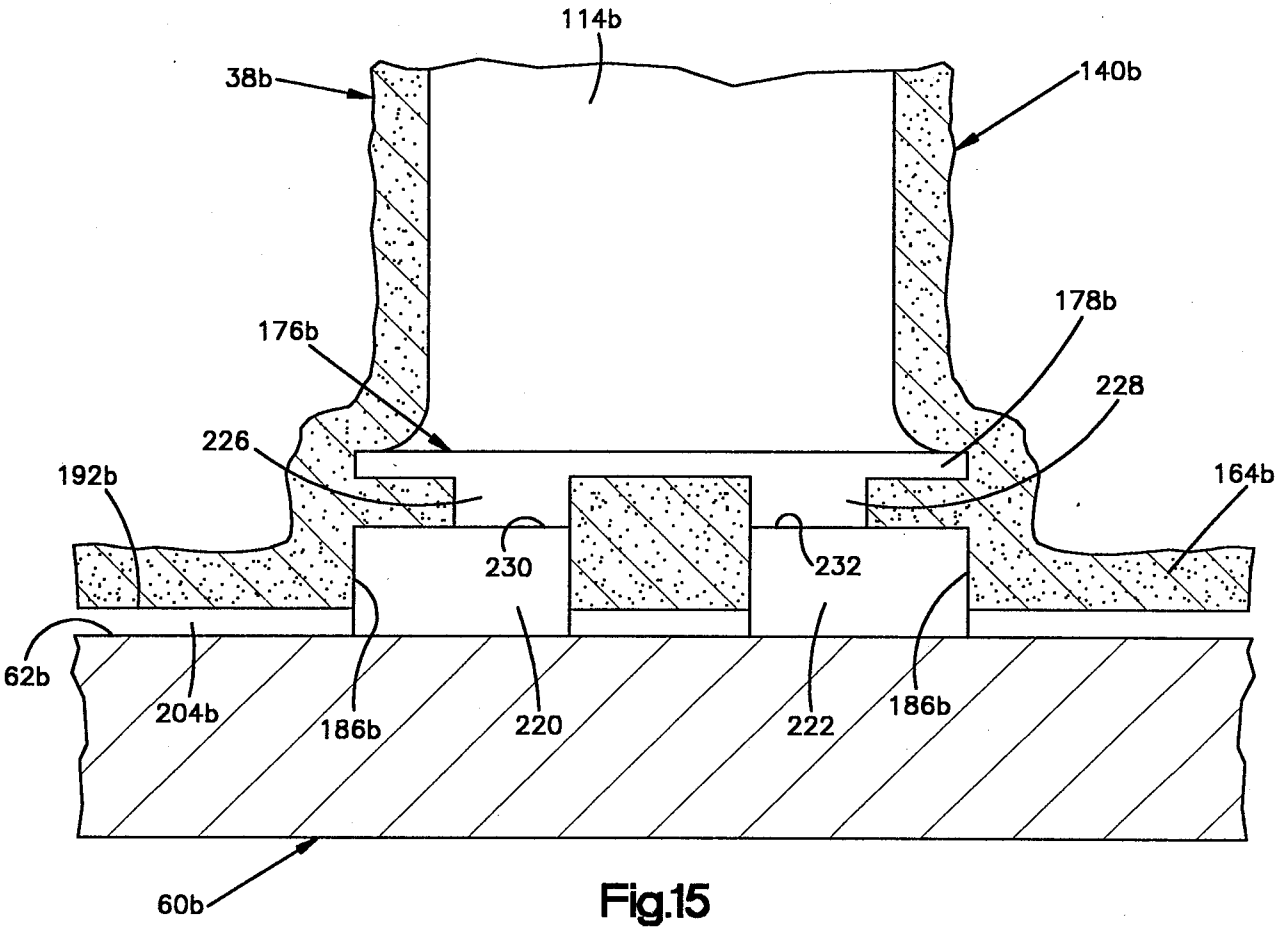
FIG. 15 is a fragmentary illustration depicting the manner in which a second embodiment of the mold structure is supported above a chill plate by chill members.

In the embodiment of the vane 10a illustrated in FIG. 8, the lower shroud portion 14a has a relatively large massive central rail 132 and relatively thin outer rails 128 and 130. However, it may be preferred to omit the relatively heavy central rail 132 and provide a pair of relatively heavy outer rails. A mold for casting such a vane is illustrated in FIG. 15. Since the embodiment of the invention illustrated in FIG. 15 is generally similar to the embodiment of the invention illustrated in FIGS. 8–14, similar numerals will be utilized to designate similar components, the suffix letter "b" being associated with the numerals of FIG. 15 in order to avoid confusion.

A mold structure 140b (FIG. 15) includes an article mold 38b having an article mold cavity 114b. The article mold cavity 114b has a long thin configuration in which an airfoil portion of a vane is cast. The airfoil portion of the vane which is cast in the article mold cavity 114b has a configuration corresponding to the configuration of the airfoil portion 16a of the vane 10a of FIG. 8.

The lower shroud portion of the vane or article which is cast in the mold 38b of FIG. 15 has a construction which is different than the construction of the lower shroud portion 14a of the vane 10a of FIG. 8. The lower shroud portion 176a of a vane or airfoil constructed in accordance with the present invention has a pair of relatively heavy outer rails which are even larger than the central rail 132 of the vane 10a of FIG. 8. Thus, each of the outer rails in this embodiment of the invention has a length of 1.6 inches, a height (measured downwardly from the platform) of 0.15 inches and a width of 0.25 inches. It should be understood that the foregoing dimensions for the rails have been set forth for purposes of clarity of illustration and not for limitation of the invention. Of course, the rails could have different dimensions if desired.

In order to cast a vane having a long thin airfoil portion with a length which is more than four inches and which is at least twenty times the thickness of the airfoil portion, a pair of chill members 220 and 222 are disposed in pockets 186b formed in an article mold 38b. The chill members are directly beneath downwardly extending shroud rail forming portions or cavities 226 and 228. The shroud rail forming cavities 226 and 228 are open at their lower ends throughout their length and width. Therefore, upper side surfaces 230 and 232 of the chill members 220 and 222 form the bottom of the shroud rail forming cavities 226 and 228.

The chill members 220 and 222 have a rectangular configuration and are disposed in chill receiving pockets 186b which also have a rectangular configuration. The chill members 220 and 222 project from the pockets 186b. This enables the chill members 220 and 222 to support the mold structure 140b on the chill plate 60b with a gap 204b between a flat upper side surface 62b of the chill plate and a flat lower side surface 192b of the mold base 164b.

When the chills 220 and 222 are to be placed in the pockets 186b, the article mold 140b is placed in an up-side-down orientation at a location spaced from the chill plate 60b. When the mold structure 140b is in an up-side-down orientation, the base plate 164b is disposed above the gating system for the mold. The lower side surface 192b of the base plate 164b is exposed and the chill members 220 and 222 can be readily inserted into the pockets 186b. Although the pockets 186b have the same rectangular configuration as the chill members 220 and 222 to provide for frictional gripping of the chill members by the mold material, the chill members may be retained in the pockets with a suitable adhesive.

During the casting of an article in the mold 38b, molten metal flows downwardly through the article mold cavity 114b into the shroud forming portion 176b of the mold. As molten metal engages the upper side surfaces 230 and 232 of the chill members 220 and 222, the molten metal quickly solidifies. The manner in which the molten metal solidifies in the long thin airfoil forming portion of the article mold cavity 114b is the same as described in conjunction with the embodiments of the invention illustrated in FIGS. 1–14.

Conclusion

In view of the foregoing description, it is apparent the present invention 196 relates to a new and improved method of casting a metal article 10a by using a chill 196. The metal article 10a may be long and thin and have an equiaxed grain structure. The article 10a is cast in a mold cavity 114a having a configuration corresponding to the configuration of the article. Although the article 10a to be cast is long and thin, the article mold cavity 114a is free of gating and risers between opposite ends of a long thin portion 174 of the mold cavity. Thus, there are no gates or risers along the length of a long thin portion 174 of the mold cavity.

When a long thin article 10a is to be cast, the mold 140 is preheated so that a lower half 82a of the portion of the article mold 238a in which the long thin portion of the article is cast is at a temperature which is close to but less than the solidus temperature of the metal of the article. The upper half 84a of the portion of the article mold 38a in which the long thin portion 174 of the article 110a is cast may be heated to a temperature which is either somewhat above or below the solidus temperature of the metal of the article to be cast. Molten metal is conducted into the article mold cavity 114a through an inlet from a gate or runner 48a at the upper end of the article mold cavity. If desired, a second gate or riser could be connected with the lower end of the article mold cavity 114a.

During and immediately after pouring, the molten metal may be simultaneously solidified along at least fifty percent of the surface area 112a of the lower half 82a of the portion 174 of the article mold cavity 114a in which the long thin portion of the article is cast and along at least fifty percent of the surface area 112a of the upper half 84a of the portion of the article mold cavity in which the long thin portion 16a of the article is cast. The molten metal in the lower half 82a of the portion 174 of the article mold cavity in which the long thin portion 16a of the article is cast is completely solidified before the molten metal in the upper half 84a of this portion of article mold cavity is completely solidified. During solidification of the molten metal with an equiaxed grain structure, shrinkage is compensated for by feeding metal to the long thin portion 174 of the article mold cavity 114a through the inlet at which molten metal was originally conducted to the long thin portion of the article mold cavity.

When the article to be cast is the turbine engine component 10a having a long thin airfoil portion 116a and a shroud portion 14a, a chill member 196 is provided in association with the shroud portion of the turbine engine component. The chill member 196 effects the temperature gradients which are set up in the casting to prevent the formation of defects in the casting at a location adjacent to the shroud. The chill member 196 is engaged by molten metal in a shroud rail forming portion 184 of the mold 38a. The chill member 196 is spaced from a platform portion 178 of the shroud forming portion 176 of the mold.

Regardless of whether or not the articles being cast have long thin portions, chill members, similar to the chill members 196, may advantageously be located in pockets 186 disposed at lower end portions of article mold cavities. The chill receiving pockets 186 have openings 190 in a bottom surface 192 of a base 164 of the mold 140. To provide access to the pockets 186, the mold 140 is turned up-side-down and the chill members are inserted into the pockets. The mold 140 is then turned right-side-up and used to cast the articles.

Although the chill members 196 can be located relative to article molds in other ways, the chill members may be advantageously used to support the mold structure 140 above a chill plate 60a. Thus, the chill members 196 support the weight of the mold structure 140 with the mold structure spaced from a chill plate 60a upon which the chill members are disposed. Heat is transmitted from molten metal in the article molds 38a through the chill members 196 to the chill plate 60a.

The chill members 196 are advantageously used to enable the long thin airfoil portion 16a to be cast with a shroud portion 14a as having a relatively heavy rail 132. However, molds for casting other types of articles may advantageously be formed with chill receiving pockets 186. The pockets for these molds may have access openings in the bottom of the mold or may have access openings at other locations.

Having described specific preferred embodiments, of the invention, the following is claimed:

1. A method of casting a metal article having a long thin airfoil portion with a length which is more than four inches and which is at least twenty times the thickness of the airfoil portion and having a shroud portion connected to one end of the airfoil portion, said method comprising the steps of forming a mold having an article mold cavity with a long thin airfoil forming portion and with a shroud forming portion at one end of the airfoil forming portion, the long thin airfoil forming portion of the article mold cavity having a length which is more than four inches and which is at least twenty times its thickness, the long thin airfoil forming portion of the article mold cavity being free of gating along its length, the shroud forming portion of the article mold cavity being disposed at the one end of the airfoil forming portion and having a relatively wide platform forming portion which extends transversely outwardly from the long thin airfoil forming portion and having a rail forming portion which is narrower than the platform forming portion and which projects from the platform forming portion in a direction away from the airfoil forming portion, the rail forming portion having an open end which is spaced from the wide platform forming portion of the article mold cavity, blocking the open end of the rail forming portion of the article mold cavity with a chill, said step of blocking the open end of the rail forming portion of the article mold cavity includes locating a chill in a position in which the chill extends across an opening in the rail forming portion of the article mold cavity and in which the chill is spaced from the platform forming portion of the article mold cavity, positioning the mold in a furnace with the long thin airfoil forming portion of the article mold cavity extending upwardly from the shroud forming portion of the article mold cavity and with the chill blocking the opening which is at the lower end of the rail forming portion of the article mold cavity and with the chill disposed beneath and spaced from the platform forming portion of the article mold cavity, heating the mold, thereafter, conducting molten metal into the article mold cavity, said step of conducting molten metal into the article mold cavity including engaging an upper side surface of the chill with the molten metal, solidifying the molten metal in the article mold cavity with an equiaxed grain structure, said step of solidifying the molten metal including simultaneously solidifying molten metal in the shroud forming portion and the long thin airfoil forming portion of the article mold cavity, said step of solidifying molten metal in the shroud forming portion including initially solidifying the molten metal in the rail forming portion of the article mold cavity at a first rate and initially solidifying the molten metal in the platform forming portion of the article mold cavity at a second rate which is less than the first rate.

2. A method as set forth in claim 1 wherein said step of positioning a chill in a position in which the chill extends across an opening at the lower end of the rail forming portion of the article mold cavity is performed with the mold in an up-side-down orientation in which the shroud forming portion of the article mold cavity is disposed above the airfoil forming portion of the article mold cavity, said method further including the step of retaining the chill against movement relative to the mold and then moving the mold from the up-side-down orientation to a right-side-up orientation in which the airfoil forming portion of the article mold cavity is disposed above the shroud forming portion of the article mold cavity, said step of conducting molten metal into the article mold cavity being performed with the mold in the right-side-up orientation.

3. A method as set forth in claim 1 wherein said step of blocking the open lower end of the rail forming portion of the article mold cavity includes providing a chill having a cylindrical body and a flat end surface, positioning the chill relative to the mold with the flat end surface of the chill extending across the opening in the rail forming portion of the article mold cavity and with a central axis of the cylindrical body of the chill extending substantially parallel to a longitudinal central axis of the long thin airfoil forming portion of the article mold cavity.

4. A method as set forth in claim 1 wherein said step of positioning a chill in a position in which the chill extends across an opening in the rail forming portion of the article mold cavity includes positioning the chill with a portion of the chill projecting outwardly of the mold, said method further including at least partially supporting the mold on the chill by engaging a support surface with the chill and with space disposed between the support surface and a portion of the mold adjacent to the chill.

5. A method as set forth in claim 1 wherein said step of conducting molten metal into the article mold cavity includes conducting molten metal downwardly through the long thin airfoil forming portion to the shroud forming portion of the article mold cavity, said step of engaging an upper side surface of the chill with the molten metal including engaging the upper side surface of the chill with molten metal which has been conducted through the long thin airfoil forming portion of the article mold cavity to the shroud forming portion of the article mold cavity.

6. A method as set forth in claim 1 further including the step of supporting the mold and chill with a chill plate, said step of supporting the mold and chill with a chill plate including engaging the chill plate with a side surface of the chill disposed opposite from the opening at the lower end of the rail forming portion of the article mold cavity.

7. A method as set forth in claim 6 wherein said step of supporting the mold and chill with the chill plate includes supporting the mold on the chill and with the mold spaced from the chill plate.

8. A method as set forth in claim 1 wherein said step of heating the mold includes heating a lower half of the portion of the mold defining the long thin airfoil forming portion of the article mold cavity and the shroud forming portion of the article mold cavity into a first temperature range, the highest temperature of the first temperature range being close to but less than the solidus temperature of the metal of the article, said step of heating the mold including heating an upper half of the portion of the mold defining the long thin airfoil forming portion of the article mold cavity into a second temperature range containing temperatures which are greater than the first temperature range, said step of conducting molten metal into the article mold cavity being initiated while the lower half of the portion of the mold defining the long thin airfoil forming portion and the shroud forming portion of the article mold cavity is in the first temperature range and the upper half of the portion of the mold defining the long thin airfoil forming portion of the article mold cavity is in the second temperature range.

9. A method as set forth in claim 1 wherein said step of solidifying the molten metal in the article mold cavity includes simultaneously solidifying molten metal along at least 50 percent of the surface area of the article mold cavity disposed in the lower half of the portion of the mold defining the long thin airfoil forming portion of the article mold cavity and along at least 50 percent of the surface area of the article mold cavity disposed in the upper half of the portion of the mold defining the long thin airfoil forming portion of the article mold cavity, completing solidification of the molten metal in the shroud forming portion of the article mold cavity prior to completion of solidification of the molten metal in the portion of the article mold cavity disposed in the lower half of the portion of the mold defining the long thin airfoil forming portion of the article mold cavity, and completing solidification of the molten metal in the portion of the article mold cavity disposed in the lower half of the portion of the mold defining the long thin airfoil forming portion of the mold cavity prior to completion of solidification of the molten metal in the portion of the article mold cavity disposed in the upper half of the portion of the mold defining the long thin airfoil forming portion of the article mold cavity.

10. A method as set forth in claim 9 wherein said steps of completing solidification of the molten metal in the shroud forming portion and in the lower half of the portion of the mold defining the long thin airfoil forming portion of the article mold cavity are performed when a major portion of the molten metal in the upper half of the portion of the mold defining the long thin airfoil forming portion of the article mold cavity has already solidified.

11. A method as set forth in claim 1 wherein said step of conducting molten metal into the article mold cavity includes conducting molten metal into the long thin airfoil forming portion of the article mold cavity at only the upper end of the long thin airfoil forming portion of the article mold cavity and conducting molten metal into the shroud forming portion of the article mold cavity only from the lower end of the long thin airfoil forming portion of the article mold cavity.

12. A method of casting a plurality of metal articles, said method comprising the steps of providing a mold structure having a plurality of article molds, a gating system connected with first end portions of the article molds and a base connected with second end portions of the article molds, the base including a plurality of pockets each of which is aligned with one of the article molds and has an outer opening on a side of the base opposite from the article molds, providing a plurality of chills, inserting the chills into the pockets through the outer openings while the mold structure is in a first orientation with the base above the gating system to expose the outer openings, thereafter, moving the mold structure onto a support surface with the plurality of chills in the pockets, said step of moving the mold structure onto a support surface including positioning the mold structure in a second orientation with the gating system above the base, conducting molten metal through the gating system into the article molds, and transmitting heat from the molten metal to the chills.

13. A method as set forth in claim 12 wherein said step of moving the mold structure onto a support surface includes moving the mold structure onto a chill plate and engaging the chill plate with each of the chills, said method further including the step of transmitting heat from each of the chills to the chill plate during performance of said step of transmitting heat from the molten metal to the chills.

14. A method as set forth in claim 12 wherein said step of moving the mold structure onto a support surface includes engaging the support surface with the chills and supporting the mold structure above the support surface on the chills.

15. A method as set forth in claim 12 further including the step of connecting each of the chills to the mold structure prior to performing said step of positioning the mold structure in a second orientation.

16. A method as set forth in claim 12 wherein each of the metal articles including an airfoil portion which is long and thin and has a length which is more than four inches and which is at least twenty times its thickness and a shroud portion connected to one end of the airfoil portion, said step of providing a mold structure including forming a plurality of article molds each of which has an article mold cavity with a long thin airfoil forming portion and with a shroud forming portion at a lower end of the airfoil forming portion, the long thin airfoil forming portion of each article mold cavity having a length which is more than four inches and is at least twenty times its thickness, the long thin airfoil forming portion of each article mold cavity being free of gating along its length, said step of conducting molten metal into the article molds including conducting molten metal downwardly through the long thin airfoil forming portion to the shroud forming portion of each of the article mold cavities, said method further including the step of engaging surfaces of the chills with molten metal which has been conducted through the long thin airfoil forming portions of the article mold cavities to the shroud forming portions of the article mold cavities.

17. A method as set forth in claim 16 wherein the shroud forming portion of each article mold cavity is disposed at a lower end of the airfoil forming portion when the mold structure is in the second orientation and has a relatively wide platform forming portion which extends transversely outwardly from the long thin airfoil forming portion and has a narrow rail forming portion which projects from the platform forming portion, said narrow rail forming portion having an open lower end which is disposed beneath and spaced from the wide platform forming portion of the article mold cavity when the mold structure is in the second orientation, said method further including blocking the open lower end of the rail forming portion of each of the article mold cavities with one of the chills by positioning a chill in abutting engagement with the mold material in a position in which the chill extends across an opening in the rail forming portion of an article mold cavity with the chill spaced from the platform forming portion of the article mold cavity.

18. A method of casting a plurality of metal articles, said method comprising the steps of providing a mold structure having a plurality of article molds with openings at their lower end portions, blocking the openings at the lower end portions of the article molds with a plurality of chill members, positioning the chill members on a chill plate, supporting the weight of the mold structure on the chill members with the mold structure spaced from the chill plate, thereafter, conducting molten metal into the article molds, and transmitting heat from the molten metal through the chill members to the chill plate.

19. A method as set forth in claim 18 wherein the mold structure includes a gating system connected with upper end portions of the article molds and a base connected with lower end portions of the article molds, said step of blocking the openings at the lower end portions of the article molds being performed with the mold structure in an up-side-down orientation in which the base of the mold structure is above the gating system, said step of supporting the weight of the mold structure on the chill members with the mold structure space from the chill plate be performed with the mold structure in a right-side-up orientation in which the gating system is above the base, said step of conducting molten metal into the article molds including conducting molten metal through the gating system to the article molds.

20. A method as set forth in claim 18 wherein said step of blocking openings at lower end portions of the article molds with a plurality of chill members is performed prior to performance of said step of positioning the chill members on a chill plate.

21. A method as set forth in claim 18 wherein the mold structure includes a gating system connected with upper end portions of the article molds and a plurality of pockets each of which is disposed adjacent to the lower end portion of an article mold, said step of blocking openings at the lower end portions of the article molds with a plurality of chill members including inserting the chill members into the pockets, said step of transmitting heat from the molten metal through the chill members to the chill plate including engaging the surfaces of the chill members with the molten metal.

22. A method as set forth in claim 18 wherein said step of supporting the weight of the mold structure on the chill members with the mold structure spaced from the chill plate includes pressing surface areas on the mold structure against the chill members under the influence of a force which is at least as great as the weight of the mold structure.

23. A method as set forth in claim 22 wherein said step of pressing the mold structure against the chill members includes sealing the openings at the lower end portions of the article molds by pressing the surface areas on the mold structure against the chill members.

24. A method as set forth in claim 18 wherein each of the metal articles includes an airfoil portion which is long and thin and has a length which is more than four inches and which is at least twenty times its thickness and a shroud portion connected to one end of the airfoil portion, the article molds each having an article mold cavity with a long thin airfoil forming portion and a shroud forming portion at a lower end of the airfoil forming portion, the long thin airfoil forming portion of each article mold cavity having a length which is more than four inches and is at least twenty times its thickness, the long thin airfoil forming portion of each article mold cavity being free of gating along its length, said step of conducting molten metal into the article molds including conducting molten metal downwardly through the long thin airfoil forming portion to the shroud forming portion of each of the article mold cavities, said step of conducting molten metal into the article molds including engaging the chill members with molten metal which has been conducted through the long thin airfoil forming portions of the article mold cavities to the shroud forming portions of the article mold cavities.

25. A method as set forth in claim 24 wherein the shroud forming portion of each article mold cavity has a relatively wide platform forming portion which extends transversely outwardly from the long thin airfoil forming portion and has a narrow rail forming portion which projects from the platform forming portion, said narrow rail forming portion having an open lower end which is disposed beneath and spaced from the wide platform forming portion of the article mold cavity, said step of blocking the openings at the lower end portions of the article molds includes blocking the open lower end of the rail forming portion of each of the article mold cavities with one of the chill members by positioning a chill member in abutting engagement with the mold material in a position in which the chill member extends across an opening in the rail forming portion of an article mold cavity with the chill member spaced from the platform forming portion of the article mold cavity.

26. A method of casting a metal article having a long thin airfoil portion with a length which is more than four inches and which is at least twenty times the thickness of the airfoil portion and having a shroud portion connected to one end of the airfoil portion, said method comprising the steps of forming a ceramic mold having an article mold cavity with a long thin airfoil forming portion and with a shroud forming portion at one end of the airfoil forming portion and having a pocket disposed on a side of the shroud forming portion opposite from the airfoil forming portion, the long thin airfoil forming portion of the article mold cavity having a length which is more than four inches and which is at least twenty times its thickness, the long thin airfoil forming portion of the article mold cavity being free of gating along its length, said step of forming a mold including providing a pattern having a long thin airfoil pattern portion, a shroud pattern portion and a pocket pattern portion, the long thin airfoil pattern portion being free of gating along its length, covering the long thin airfoil pattern portion, the shroud pattern portion and the pocket pattern portion of the pattern with a wet coating of ceramic mold material, drying the coating of ceramic mold material, and removing the pattern from within the dried coating of ceramic mold material to form the article mold cavity with the airfoil forming portion and the shroud forming portion and to form the pocket, said method further including placing a chill member in the pocket, positioning the mold in a furnace with the long thin airfoil forming portion of the article mold cavity extending upwardly from the shroud forming portion of the article mold cavity and with the chill member disposed in the pocket beneath the shroud forming portion of the article mold cavity, heating the mold, thereafter, conducting molten metal into the article mold cavity, said step of conducting molten metal into the article mold cavity including conducting molten metal into the long thin airfoil forming portion at a location other than along the length of the airfoil forming portion, solidifying the molten metal in the article mold cavity with an equiaxed grain structure, said step of solidifying the molten metal including transmitting heat from the shroud forming portion to the chill member in the pocket.

27. A method as set forth in claim 26 wherein said step of positioning the mold in a furnace includes positioning the mold on a chill plate, said step of solidifying the molten metal including transmitting heat from the chill member in the pocket to the chill plate.

28. A method as set forth in claim 27 wherein said step of position the mold on the chill plate includes engaging the chill plate with the chill member and at least partially supporting the weight of the mold with the chill member.

29. A method as set forth in claim 26 wherein said step of placing the chill member in the pocket is performed with the mold in an up-side-down orientation in which the pocket is above the article mold cavity, said step of positioning the mold in the furnace including positioning the mold in the furnace in a right-side-up orientation in which the pocket is below the article mold cavity.

30. A method as set forth in claim 26 wherein said step of conducting molten metal into the article mold cavity includes engaging the chill member with the molten metal.

31. A method as set forth in claim 26 wherein said step of positioning the mold in a furnace includes engaging a chill plate with the chill member and at least partially supporting the mold on the chill member with the mold spaced apart from the chill plate.

32. A method of casting a metal article at least a portion of which is long and thin and has a length which is more than four inches and which is at least twenty times its thickness and having an enlarged end portion connected to the long thin portion, said method comprising the steps of forming a mold having an article mold cavity having a long thin portion which has a length which is more than four inches and is at least twenty times its thickness and having an enlarged end portion at one end of the long thin portion, the long thin portion of the article mold cavity being free of gating along its length, positioning a chill member on a side of the enlarged end portion of the article mold cavity opposite from the long thin portion of the article mold cavity, positioning the mold in a furnace with the chill member engaging a chill plate, heating the mold, said step of heating the mold including heating a lower half of the portion of the mold defining the long thin portion of the article mold cavity into a first temperature range, the highest temperature of the first temperature range being close to but less than the solidus temperature of the metal of the article, said step of heating the mold including heating an upper half of the portion of the mold defining the long thin portion of the article mold cavity into a second temperature range containing temperatures which are greater than the first temperature range, conducting molten metal into the article mold cavity, said step of conducting molten metal into the article mold cavity including conducting molten metal into the long thin portion of the article mold cavity at a location other than along the length of the long thin portion of the article mold cavity and conducting molten metal into the enlarged end portion of the article mold cavity, said step of conducting molten metal into the article mold cavity being initiated while the lower half of the portion of the mold defining the long thin portion of the article mold cavity is in the first temperature range and the upper half of the portion of the mold defining the long thin portion of the article mold cavity is in the second temperature range, and solidifying the molten metal in the article mold cavity with an equiaxed grain structure, said step of solidifying the molten metal including transmitting heat from the molten metal through the chill member to the chill plate.

33. A method as set forth in claim 32 wherein said step of solidifying the molten metal in the article mold cavity includes simultaneously solidifying molten metal along at least 50 percent of the surface area of the article mold cavity disposed in the lower half of the portion of the mold defining the long thin portion of the article mold cavity and along at least 50 percent of the surface area of the article mold cavity disposed in the upper half of the portion of the mold defining the long thin portion of the article mold cavity, and completing solidification of the molten metal in the portion of the article mold cavity disposed in the lower half of the portion of the mold defining the long thin portion of the article mold cavity prior to completion of solidification of the molten metal in the portion of the article mold cavity disposed in the upper half of the portion of the mold defining the long thin portion of the article mold cavity.

34. A method as set forth in claim 33 wherein said step of completing solidification of the molten metal in the lower half of the portion of the mold defining the long thin portion of the article mold cavity is performed at a time when a major portion of the molten metal in the upper half of the portion of the mold defining the long thin portion of the article mold cavity has already solidified.

35. A method as set forth in claim 32 wherein said step of conducting molten metal into the article mold cavity includes conducting molten metal into the long thin portion of the article mold cavity at only one end of the long thin portion of the article mold cavity.

36. A method of casting a metal article at least a portion of which is long and thin and has a length which is more than four inches and which is at least twenty times its thickness and having an enlarged end portion connected to the long thin portion, said method comprising the steps of forming a mold having an article mold cavity having a long thin portion with a length which is more than four inches and is at least twenty times its thickness and having an enlarged end portion at one end of the long thin portion, the long thin portion of the article mold cavity being free of gating along its length, positioning a chill member on a side of the enlarged end portion of the article mold cavity opposite from the long thin portion of the article mold cavity, positioning the mold in a furnace with the chill member engaging a chill plate, heating the mold, conducting molten metal into the article mold cavity, said step of conducting molten metal into the article mold cavity including conducting molten metal into the long thin portion of the article mold cavity at a location other than along the length of the long thin portion of the article mold cavity and conducting molten metal into the enlarged end portion of the article mold cavity, solidifying the molten metal in the article mold cavity, said step of solidifying the molten metal including transmitting heat from the molten metal through the chill member to the chill plate, and completing solidification of the molten metal in a lower half of the long thin portion of the article mold cavity and the enlarged end portion of the article mold cavity prior to completion of solidification of the molten metal in an upper half of the long thin portion of the article mold cavity and after a major portion of the molten metal in the upper half of the long thin portion of the article mold cavity has solidified.

37. A method as set forth in claim 36 wherein said step of heating the mold includes heating the lower half of the portion of the mold defining the long thin portion of the article mold cavity into a first temperature range having an average temperature of less than 2,250° F., the highest temperature in the first temperature range being close to but less than the solidus temperature of the metal of the article, said step of heating the mold including heating the upper half of the portion of the mold defining the long thin portion of the article mold cavity into a second temperature range containing temperatures which are greater than the first temperature range and having an average temperature of less than 2,500° F., said step of conducting molten metal into the article mold cavity including conducting molten metal into the article mold with the metal at a temperature above 2,400° F.

38. A method as set forth in claim 36 wherein said step of solidifying the molten metal includes initiating solidification of the molten metal over a large majority of the surface area of the long thin portion of the article mold cavity.

39. A method as set forth in claim 36 wherein said step of solidifying molten metal in the article mold cavity includes simultaneously solidifying molten metal along at least 50 percent of the surface area of the article mold cavity disposed in the lower half of the portion of the mold defining the long thin portion of the article mold cavity and along at least 50 percent of the surface area of the article mold cavity disposed in the upper half of the portion of the mold defining the long thin portion of the article mold cavity.

40. A method as set forth in claim 36 wherein said step of solidifying the molten metal includes forming a thin layer of equiaxed metal over a large majority of the surface area of the mold cavity defining the long thin portion of the article mold cavity and, thereafter, growing dendrites inwardly and upwardly from the thin skin extending over the large majority of the surface area of the mold cavity defining the long thin portion of the article mold cavity.

41. A method as set forth in claim 40 wherein said step of growing dendrites inwardly and upwardly from the thin skin includes growing dendrites upwardly from the thin skin at a greater rate than dendrites are grown inwardly from the thin skin.

* * * * *